US009004301B2

(12) United States Patent
Wahlstrom

(10) Patent No.: US 9,004,301 B2
(45) Date of Patent: Apr. 14, 2015

(54) COMPARTMENTALIZED CONTAINER

(71) Applicant: Matthew Wahlstrom, Warrenton, VA (US)

(72) Inventor: Matthew Wahlstrom, Warrenton, VA (US)

( * ) Notice: Subject to any disclaimer, the term of this patent is extended or adjusted under 35 U.S.C. 154(b) by 179 days.

(21) Appl. No.: 13/651,025

(22) Filed: Oct. 12, 2012

(65) Prior Publication Data

US 2013/0037506 A1 Feb. 14, 2013

Related U.S. Application Data

(63) Continuation-in-part of application No. 12/332,243, filed on Dec. 10, 2008, now Pat. No. 8,292,099.

(51) Int. Cl.

| | |
|---|---|
| ***A47G 19/30*** | (2006.01) |
| ***A61J 9/00*** | (2006.01) |
| ***A61J 1/20*** | (2006.01) |
| ***B65D 81/32*** | (2006.01) |

(52) U.S. Cl.
CPC *A61J 9/00* (2013.01); *A61J 1/2093* (2013.01); *B65D 81/3211* (2013.01); *A61J 2001/2031* (2013.01); *Y10S 215/08* (2013.01)

(58) Field of Classification Search
USPC ..... 215/6, 11.1, 11.4, 313; 206/221, 219, 206/459; 222/44.5, 153.01, 153.12, 153.04, 222/144, 561, 138, 139
See application file for complete search history.

(56) References Cited

U.S. PATENT DOCUMENTS

| | | | | |
|---|---|---|---|---|
| 2,372,281 | A | 3/1945 | Jordan | |
| 4,779,722 | A | 10/1988 | Hall | |
| 5,638,968 | A | 6/1997 | Baron et al. | |
| 5,794,802 | A | 8/1998 | Caola | |
| 5,823,346 | A | 10/1998 | Weiner | |
| 5,897,013 | A * | 4/1999 | Manganiello | 220/252 |
| 6,089,389 | A | 7/2000 | Sharon et al. | |
| 6,113,257 | A | 9/2000 | Sharon et al. | |
| 6,116,439 | A * | 9/2000 | Yaniv | 215/11.1 |
| 6,945,393 | B2 | 9/2005 | Cho | |
| 7,150,369 | B1 | 12/2006 | Fryar | |
| 7,308,915 | B2 | 12/2007 | Johns et al. | |
| 7,331,478 | B2 * | 2/2008 | Aljadi | 215/11.4 |
| 7,413,074 | B2 | 8/2008 | Barr | |
| 7,484,633 | B1 | 2/2009 | Moher | |
| 7,850,027 | B2 | 12/2010 | Hayes et al. | |
| 7,866,511 | B2 | 1/2011 | Harrison et al. | |
| 8,028,847 | B2 | 10/2011 | Klaver et al. | |
| 8,146,758 | B1 | 4/2012 | Peres | |
| 2009/0178940 | A1 | 7/2009 | Said | |
| 2011/0068080 | A1 * | 3/2011 | Weissich | 215/387 |
| 2011/0114589 | A1 | 5/2011 | Bathan et al. | |

FOREIGN PATENT DOCUMENTS

| | | |
|---|---|---|
| AT | 413095 | 5/2005 |
| EP | 1645518 | 4/2006 |
| FR | 2615729 | 12/1998 |

OTHER PUBLICATIONS www.bbox.com.au/baby-bottle (Oct. 9, 1929).

* cited by examiner

*Primary Examiner* — Fenn Mathew
*Assistant Examiner* — Cynthia Collado

(57) ABSTRACT

A container having an first chamber; a second chamber; an upper seal forming a lower portion of the upper chamber; a lower seal adjacent the upper seal, the lower seal forming an upper portion of the lower chamber; a plurality of upper seal apertures in the upper seal; and a plurality of lower seal apertures in the lower seal, the upper seal apertures and the lower seal apertures rotatable between an open position with the upper and lower seal apertures aligned and a closed position with the upper and lower seal apertures nonaligned.

11 Claims, 28 Drawing Sheets

COMPARTMENTALIZED CONTAINER

BENEFIT CLAIM UNDER 35 U.S.C. 120

This application is a continuation-in-part of prior application Ser. No. 12/332,243, filed Dec. 10, 2008, the entire contents of which are incorporated by reference herein.

BACKGROUND OF THE INVENTION

1. Field of the Invention

The present invention relates generally to baby bottles and, more specifically, to a compartmentalized baby bottle having a dry food product compartment and a fluid product selectively rotative from a separable state to a communicating state whereby the products can be mixed for consumption. The bottle has a removable lid portion for filling with a dry food product and a removable bottom portion for filling with a fluid product. The bottle, having a pair of plates with co-aligned apertures that are positionable to segregate one compartment from the other positionable to a communicative state whereby the contents can be mixed. The bottle, having a locking mechanism to prevent casual displacement of one plate relative to the other to prevent unintended mixing of the contents. Alternate designs of the present invention are provided and are hereinafter described. As should be readily apparent to one having ordinary skill in the art, the invention may apply to any bottle or, more generally, container having plural chambers, and be configured for any use with any substance.

2. Description of the Prior Art

There are other chambered baby bottles designed for a similar purpose. Typical of these is U.S. Pat. No. 4,779,722 issued to Hall on Oct. 25, 1988.

Another patent was issued to Baron et al. on Jun. 17, 1997 as U.S. Pat. No. 5,638,968. Yet another U.S. Pat. No. 5,794,802 was issued to Caola on Aug. 18, 1998 and still yet another was issued on Jul. 18, 2000 to Sharon et al. as U.S. Pat. No. 6,089,389.

Another patent was issued to Sharon et al. on Sep. 5, 2000 as U.S. Pat. No. 6,113,257. Yet another U.S. Pat. No. 6,116,439 was issued to Yaniv on Sep. 12, 2000. Another was issued to Johns et al. on Dec. 18, 2007 as U.S. Pat. No. 7,308,915 and still yet another was issued on Dec. 2, 1988 to Gravi as France Patent No. FR2615729.

Another patent was issued to Plastikwerk on Apr. 15, 2005 as Austria Patent No. AT4130958. Yet another European Patent No. EP1645518 was issued to Azani on Apr. 12, 2006.

U.S. Pat. No. 4,779,722

Inventor: John Hall

Issued: Oct. 25, 1988

A container adapted to contain a number of ingredients separated until intermixture thereof is desired, consisting of a bottle having a plurality of sections each adapted to carry one of the ingredients, successive pairs of sections being separated by partitions each carrying a normally closed valve which when opened establishes communication between the associated bottle sections. The valves are individually operable manually, so that if three or more materials are to be intermixed, the order of intermixture may be controlled, and also may be closely regulated as to the degree of opening, whereby to control the rate on intermixture. A lock is also provided to prevent accidental opening of any of the valves until intermixture is desired.

U.S. Pat. No. 5,638,968

Inventor: Moises Baron et al.

Issued: Jun. 17, 1997

An extension assembly fits between a tubular container of a baby bottle and a nipple end cap. The assembly includes a container body attached to the nipple end cap and having an internal chamber and a lower attaching structure connected to an upper open end of the tubular container and a release mechanism to control access by water in the tubular container to food material in the container body. The mechanism has a lower annular funnel sloping from an annular outer edge to an annular inner edge which defines a central opening aligned with the upper end of the tubular container. A central stopper structure supported by a lower open end of the container body is movable toward and away from the annular funnel structure as the container body moves within a sleeve extending upwards from the annular funnel structure. This movement prevents and permits access by water in the tubular container to the food material in the container body.

U.S. Pat. No. 5,794,802

Inventor: Joseph Caola

Issued: Aug. 18, 1998

A reusable insert designed for off-the-shelf covered containers, and more specifically for baby bottles. The insert forms a storage compartment and which keeps the ingredients separated in the container. It is designed to allow the ingredients to be mixed in the same container and dispensed without removing the cover from the container. The insert generally includes a dry chamber housing, a chamber seal, and a means to release the chamber seal such as a push rod. When used with a baby bottle, the insert slides into the bottle portion. A flange at the top of the dry chamber housing prevents it from moving too far into the bottle and still allows the nipple assembly to be attached directly to the bottle portion. When the nipple assembly is screwed in place, the flange is pinched between the nipple assembly and bottle portion, forming a leak-proof seal. The dry chamber housing and chamber seal together form a cup-like container which stores the powdered formula prior to the ingredients being mixed. The means to release the chamber seal, in this case a push rod operates through the nipple with either a push action or a combination of push/rotary action. The insert containing powdered formula slides into the open neck of the bottle portion containing a pre-measured amount of water and the nipple assembly is screwed in place. To mix the ingredients, the user pushes on the nipple which displaces the chamber seal and provides a passage for water and formula to combine in both the bottle portion and the dry chamber housing. The bottle is then shaken and the formula is dispensed. Other designs for the chamber seal and the means to release the chamber seal are specified.

U.S. Pat. No. 6,089,389

Inventor: Igal Sharon et al.

Issued: Jul. 18, 2000

A container holding two separate components, which are mixed prior to use is provided. The container comprises a housing defining a first compartment having a sealable opening and a neck portion between said first compartment and said opening. The container further comprises a displaceable member which is disposed within the housing which has a partition wall with an edge adapted for sealing engagement with the internal wall of the neck portion, thereby defining a second compartment sealed from the first compartment and being in flow communication with the opening. The displaceable member is axially displaceable between two positions along an axis extending through the neck portion. These two positions comprise a first position where the edge of the partition wall sealably engages the internal walls of the neck portion, and a second position where the edge of the partition wall and the internal walls of the neck portion are disengaged, permitting flow communication between the two compartments. The container with two components is prepared by first introducing a first component into the first compartment, placing the displacable member within the compartment and fitting it into said first position, introducing the second component into the second compartment and sealing the opening.

U.S. Pat. No. 6,113,257

Inventor: Igal Sharon et al.

Issued: Sep. 5, 2000

A container holding two separate components which are mixed prior to use is provided. The container comprises a housing with a dispensing opening and neck portion between said opening and the bottom end of housing. The container further comprises a displaceable member disposed within the housing and having a partition wall with an edge adapted for a sealing engagement with internal walls of the neck portion, thereby defining two compartments separated by said partition wall. A displaceable member is axially displaceable between two positions along an axis extending through the neck portion. These two positions comprise a first position where the edge of the partition wall sealingly engages the internal walls of the neck portion, and a second position where the edge of the partition wall and the internal walls are disengaged permitting flow communication between the two compartments. This flow communication allows mixing of the two components to form a formulation which is then ready for use.

U.S. Pat. No. 6,116,439

Inventor: Wendy Yaniv

Issued: Sep. 12, 2000

A baby bottle and milk storage assembly configured to define a segmented configuration, with each segment being useful for storing and dispensing a food product used for feeding an infant. The bottle assembly is configured such that a plurality of bottle segments may be joined in fluid communication in an end-to-end fashion. For storage, individual or joined segments may be easily stacked in a nesting relationship. The bottle assembly includes at least one bottle segment, at least one end cap, at least one connector ring, and a neck member. An end cap is secured to the bottom end of a bottle segment and serves to close the bottom end of the bottle segment and as a base for the bottle assembly. Either an end cap or a connector ring is mounted on the upper end of the bottle segment. In the event a connector ring is mounted on the upper end of the bottle segment, another bottle segment or a neck member is mounted thereon. The end cap defines an end wall about which is disposed an annular wall which defines an upper end extending above the end wall and a lower end extending below the end wall. The lower end of the annular wall defines an enlarged radius to accomplish nesting of two such end caps.

U.S. Pat. No. 7,150,369

Inventor: Kimberly Fryar

Issued: Dec. 19, 2006

A dual chamber infant bottle for minimizing contamination of an entire batch of baby formula or milk includes an upper feeding reservoir with a conventional baby bottle nipple coupled to the top end thereof. The lower end of the feeding reservoir includes a base portion having an opening therethrough for receiving fluid from a storage reservoir. A valve assembly is removably disposed between the storage reservoir and feeding reservoir for allowing selective flow therebetween.

U.S. Pat. No. 7,308,915

Inventor: Garry Johns et al.

Issued: Dec. 18, 2007

A packaging system is provided for storing and mixing separate ingredient components. The system includes a first bottle used for storing a first ingredient component which includes a dispensing port disposed on a top end, a mixing port disposed on a bottom end, and a seal integrated within the mixing port. The system also includes a second bottle used for storing a second component ingredient which includes a bottle neck having an opening disposed therein wherein the neck is adapted to be installed into the mixing port of the first bottle. Also, an extended tip is formed on the distal end of the bottle neck. When the bottle neck of the second bottle is installed into the mixing port of the first bottle, the seal from the first bottle is broken by the extended tip from the second bottle establishing fluid communication between the first and second bottles and allowing the ingredient components to mix.

U.S. Pat. No. 7,331,478

Inventor: Salma Aljadi

Issued: Feb. 19, 2008

A dual chamber nursery bottle including upper and lower cylindrical shaped chambers disposed on a common axis one above the other and separated from one another by a rotatable valve assembly that is disposed on the common axis and in contact with the upper and lower chambers.

France. Patent Number FR2615729

Inventor: Philippe De Gravi

Issued: Dec. 2, 1998

It consists of two parts A containing the mineral water and B containing the milk powder (FIG. 1). These two compartments are separated by the walls y and w. This assembly is made leaktight by seals 1 and 2. 180 degrees rotation of B on A using a stud 11 in the groove 10 brings y and w one above the other, thus uncovering a hole which makes B and A communicate, and therefore the milk powder and the mineral water mix. This feeding bottle, ready to use, and disposable after use, is perfectly adapted to use of feeding babies and can be heated in a microwave oven.

Austria Patent Number AT413095B

Inventor: Expan Gesmbh Plastikwerk

Issued: Apr. 15, 2005

The container, with two zones to hold separated fluids which are to be mixed together only at the time of use, has a bottle-shaped lower section with the first holding zone and an upper section to give the other holding zone, fitted on to the bottom section. The second fluid holding zone is linked to the holding zone at the bottom section through an opening which is covered by a membrane or a closure plug. The opening is released, directly before use, to allow the separated fluids to mix together. The membrane can be pierced by a cutting edge, operated by the container cap. When a plug is fitted, the container cap has a plunger to push the plug out of the opening. Turning the container cap in a screw movement operates the membrane cutter or plunger to detach the plug. The two container sections are held together in a screw or snap-lock fitting.

European Patent Number EP1645518

Inventor: Adam Azani

Issued: Apr. 12, 2006

A drink container has two chambers separated by a membrane and holding different liquids, e.g. alcohol and drink preparation, drink preparation and drink concentrate etc. The chambers are set one above the other. A release element is attached to the membrane and leads to the closure. When the container is opened the release element breaks the membrane and the two drink components can be mixed prior to serving.

While these chambered baby bottles may be suitable for the purposes for which they were designed, they would not be as suitable for the purposes of the present invention, as hereinafter described. The present invention provides a dual chambered baby bottle having a threaded nipple top, with plastic cover, a first chamber for holding dry baby formula mix and a second, lower chamber for holding a measured amount of water. Each chamber provides a seal having apertures. The upper seal apertures must align to the lower seal apertures to allow the formula in the upper chamber to mix with the water in the lower chamber. This is achieved by releasing the safety latch and twisting the top portion to the right while twisting the lower portion to the left, aligning the apertures and allowing the formula to mix with the water.

SUMMARY OF THE PRESENT INVENTION

A primary object of the present invention is to provide a compartmentalized baby bottle having a dry food product compartment and a fluid product selectively rotative from a separable state to a communicating state whereby the products can be mixed for consumption.

Another object of the present invention is to provide a baby bottle having a removable lid portion for filling with a dry food product and a removable bottom portion for filling with a fluid product.

Yet another object of the present invention is to provide a baby bottle having, a pair of plates with co-aligned apertures that are positionable to segregate one compartment from the other positionable to a communicative state whereby the contents can be mixed.

Still yet another object of the present invention is to provide a baby bottle having a locking mechanism to prevent casual displacement of one plate relative to the other to prevent unintended mixing of the contents.

Another object of the present invention is to provide a baby bottle allowing for a measured amount of fluid to be placed within a chamber.

Yet another object of the present invention is to provide a measured amount of dry formula to be placed within its respected chamber.

Another object of the present invention is to provide a dual chambered baby bottle as a first design having a threaded nipple top, with plastic cover, a first chamber for holding dry baby formula mix and a second, lower chamber for holding a measured amount of water. Each chamber provides a seal having apertures. The upper seal apertures must align to the lower seal apertures to allow the formula in the upper chamber to mix with the water in the lower chamber. This is achieved by twisting the top portion to the right while twisting the lower portion to the left, allowing the spring pin to travel along until it pops into the spring lock port, aligning the apertures and allowing the formula to mix with the water. The spring pin lock port is designed with a somewhat concave lip which allows the spring pin to leave the port when a forced opposite twist is applied, and allowing the mixing apertures back to a closed position.

Yet another object of the present invention is a dual chambered baby bottle as a second design having a threaded nipple top, with plastic cover, a first chamber for holding dry baby formula mix and a second, lower chamber for holding a measured amount of water. Each chamber provides a seal having apertures. The upper seal apertures must align to the lower seal apertures to allow the formula in the upper chamber to mix with the water in the lower chamber. This is achieved by twisting the top portion to the right while twisting the lower portion to the left, allowing the pin to ride along the channel to its stopping point, aligning the apertures and allowing the formula to mix with the water.

Another object of the present invention is to provide a dual chambered baby bottle as a third design having a threaded nipple top, with plastic cover, a first chamber for holding dry baby formula mix and a second, lower chamber for holding a measured amount of water. Each chamber provides a seal having apertures. The upper seal apertures must align to the lower seal apertures to allow the formula in the upper chamber to mix with the water in the lower chamber. This is achieved by releasing the safety latch and twisting the top portion to the right while twisting the lower portion to the left, aligning the apertures and allowing the formula to mix with the water.

Additional objects of the present invention will appear as the description proceeds.

The present invention overcomes the shortcomings of the prior art by providing a dual chambered baby bottle having a threaded nipple top, with plastic cover, a first chamber for holding dry baby formula mix and a second, lower chamber for holding a measured amount of water. Each chamber provides a seal having apertures. The upper seal apertures must align to the lower seal apertures to allow the formula in the upper chamber to mix with the water in the lower chamber. This is achieved several locking designs, all including twisting the top portion to the right while twisting the lower portion to the left, aligning the apertures and allowing the formula to mix with the water.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
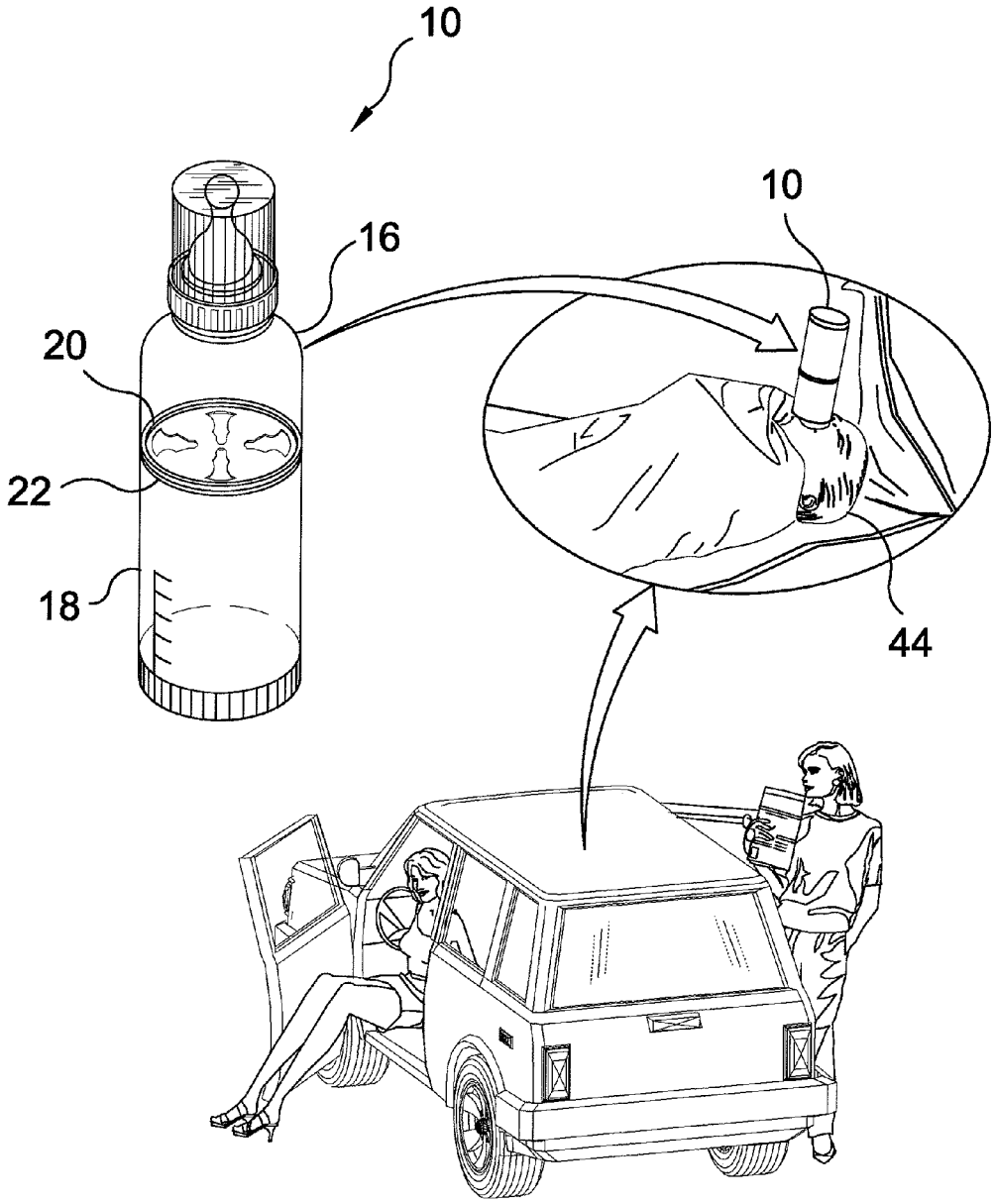
FIG. 1 is an illustrative view of the present invention in use.

Turning now descriptively to the drawings, in which similar reference characters denote similar elements throughout the several views, the figures illustrate the electronic book of the present invention. With regard to the reference numerals used, the following numbering is used throughout the various drawing figures.

10 dual chambered baby bottle
12 threaded nipple top
14 plastic cover for top
16 upper chamber
18 lower chamber
20 upper seal
22 lower seal
24 upper seal apertures
26 lower seal apertures
28 safety latch
30 o-ring
32 spring pin
34 spring pin lock port
36 concave lip on said lock port
38 pin
40 channel
42 screw-on bottom
44 infant
46 graduated measurement scale
50 nipple
52 dry formula
54 fluid
56 concave lip of 34
58 pin spring
60 pin stop
70 optional connector
72 built-in straw
74 removable lid
76 retractable tab

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is a dual chambered baby bottle 10 having a lower chamber 18 containing a fluid such as water and an upper chamber 16 containing a dry food such as baby formula mix. The two chambers are separated by an upper seal 20 and a lower seal 22 having corresponding apertures that are nonaligned to separate the contents therein until the user rotates one chamber relative to the other to align the apertures and allow the contents to mix. The dual chambered baby bottle 10 simplifies the process of feeding an infant 44 when traveling.

Figure 2A:
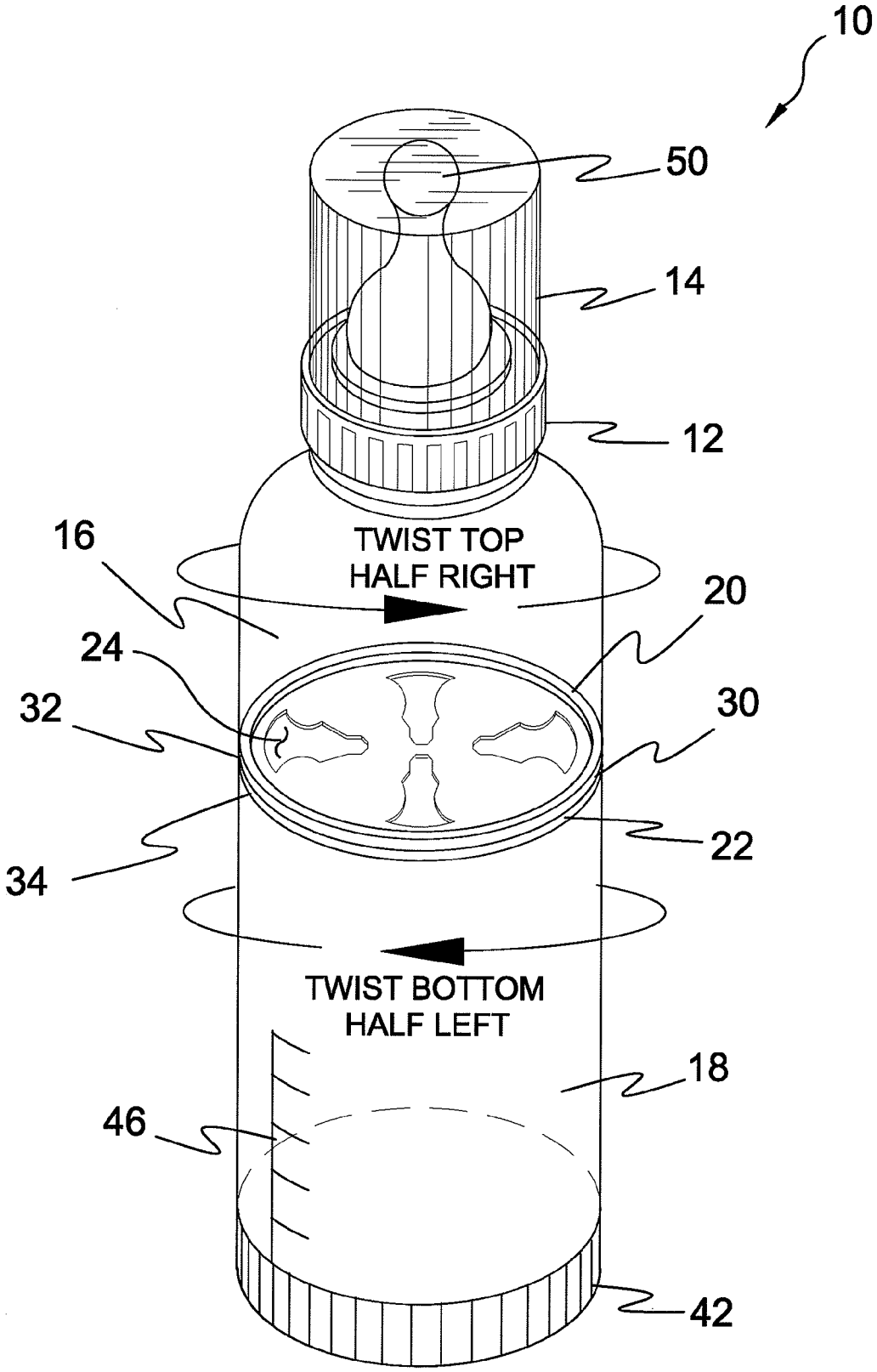
FIG. 2A is a perspective view of the first design of the present invention.

FIG. 2A is a perspective view of the first design of the present invention 10. Shown is a perspective view of the first design of the present invention, a dual chambered baby bottle 10 having a threaded nipple top 12 with nipple 50, a plastic cover 14 for the threaded nipple top 12, an upper chamber 16 in fluid communication with the nipple top 12, a lower chamber 18, an upper seal 20 forming a lower portion of the upper chamber, a lower seal 22 adjacent the upper seal 20, the lower seal 22 forming an upper portion of the lower chamber, a plurality of upper seal apertures 24 in the upper seal 20, and a plurality of lower seal apertures in the lower seal 22, the upper seal 20 and lower seal 22 rotatable between an open position with the upper seal apertures 24 and the lower seal apertures aligned and a closed position with the upper seal apertures 24 and the lower seal apertures nonaligned. This is achieved by twisting the top portion to the right while twisting the lower portion to the left, allowing the spring pin 32 to travel along until it pops into the spring lock port 34, aligning the apertures and allowing the formula to mix with the water. The spring pin lock port 34 is designed with a somewhat concave lip which allows the spring pin 32 to leave the port 34 when a forced opposite twist is applied, and allowing the mixing apertures back to a closed position. In using the present invention, first a liquid is placed into the lower chamber 18, then the upper seal 20 and lower seal 22 are rotated to a closed position and a dry food is placed into the upper chamber 16. The bottle 10 is sealed by affixing the threaded nipple top 12. When the user is ready to mix the liquid with the dry food, the upper seal 20 and the lower seal 22 are rotated to an open position and the dry food is mixed with the liquid. The lower chamber 18 further comprises a graduated measurement scale 46 and a screw-on bottom 48. In a preferred embodiment of the invention, the dry food is powdered baby formula and the liquid is water.

Optionally, the upper seal 22 further comprises an o-ring 30. The upper seal 20 can further comprise a spring pin 32 and a spring pin lock port 34, the spring pin 32 and the spring pin lock port 34 adapted such that the spring pin 32 pops into the spring pin lock port 34 when the upper seal apertures 24 and the lower seal apertures are aligned. The dual chamber baby bottle 10 of the present invention can further include a screw-on bottom 42.

Figure 2B:
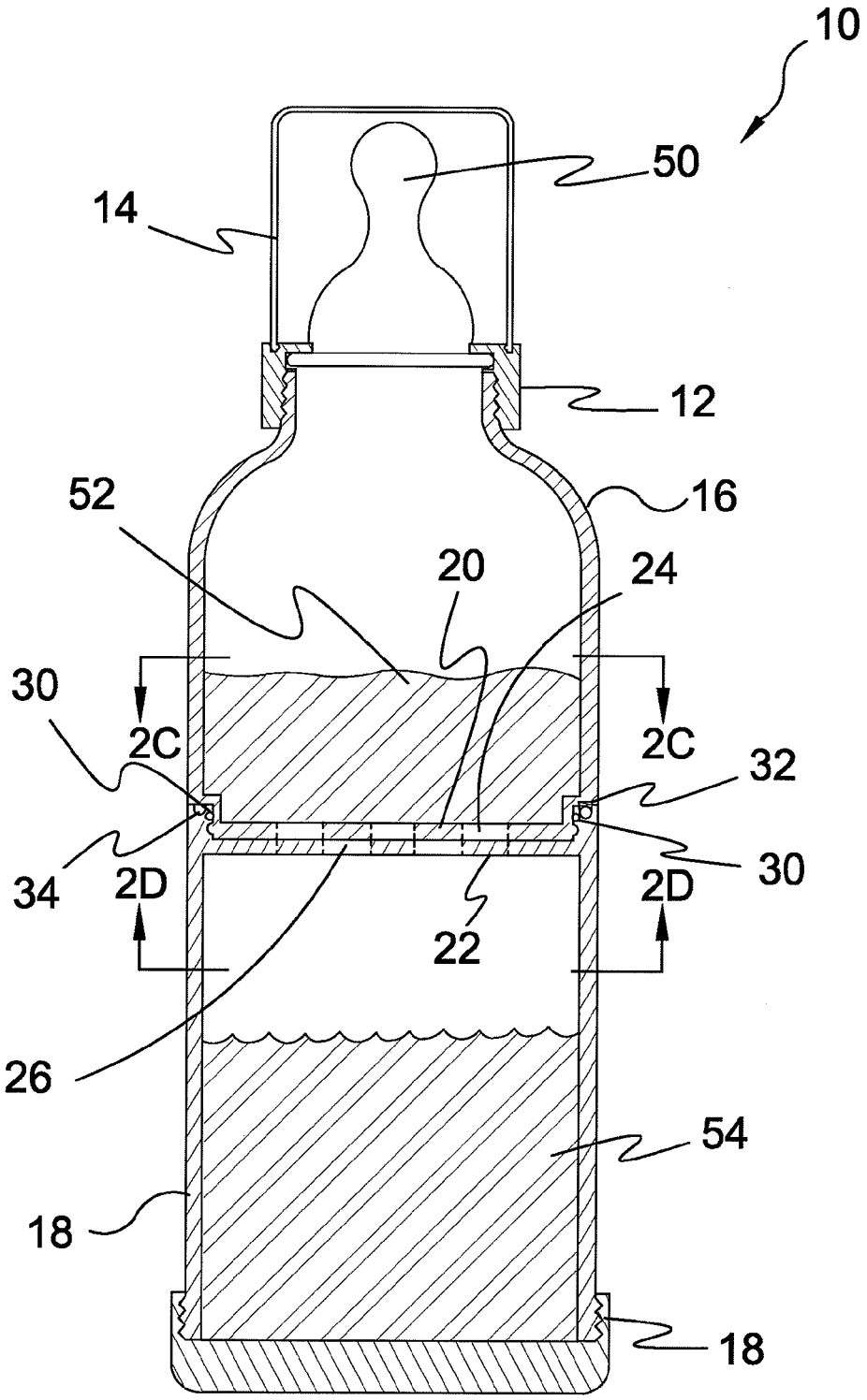
FIG. 2B is a sectional view of the first design of the present invention in a closed position.

FIG. 2B is a sectional view of the first design of the present invention 10 in a closed position. Shown is a sectional view of the first design of the present invention, a dual chambered baby bottle 10 having a threaded nipple top 12, a plastic cover 14 for the threaded nipple top 12 with nipple 50, an upper chamber 16 in fluid communication with the nipple top 12, a lower chamber 18, an upper seal 20 forming a lower portion of the upper chamber, a lower seal 22 adjacent the upper seal 20, the lower seal 22 forming an upper portion of the lower chamber, a plurality of upper seal apertures 24 in the upper seal 20, and a plurality of lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 non-aligned. This is achieved by twisting the top portion to the right while twisting the lower portion to the left, allowing the spring pin 32 to travel along until it pops into the spring lock port 34, aligning the apertures and allowing the formula 52 to mix with the water 54. The spring pin lock port 34 is designed with a somewhat concave lip which allows the spring pin 32 to leave the port 34 when a forced opposite twist is applied, and allowing the mixing apertures back to a closed position. In using the present invention, first a liquid 54 is placed into the lower chamber 18, then the upper seal 20 and lower seal 22 are rotated to a closed position and a dry food 52 is placed into the upper chamber 16. The bottle 10 is sealed by affixing the threaded nipple top 12. When the user is ready to mix the liquid 54 with the dry food 52, the upper seal 20 and the lower seal 22 are rotated to an open position and the dry food is mixed with the liquid. In a preferred embodiment of the invention, the dry food is powdered baby formula and the liquid is water.

Optionally, the upper seal 22 further comprises an o-ring 30. The upper seal 20 can further comprise a spring pin 32 and a spring pin lock port 34, the spring pin 32 and the spring pin lock port 34 adapted such that the spring pin 32 pops into the spring pin lock port 34 when the upper seal apertures 24 and the lower seal apertures are aligned. The dual chamber baby bottle 10 of the present invention can further include a screw-on bottom 42.

Figure 2C:
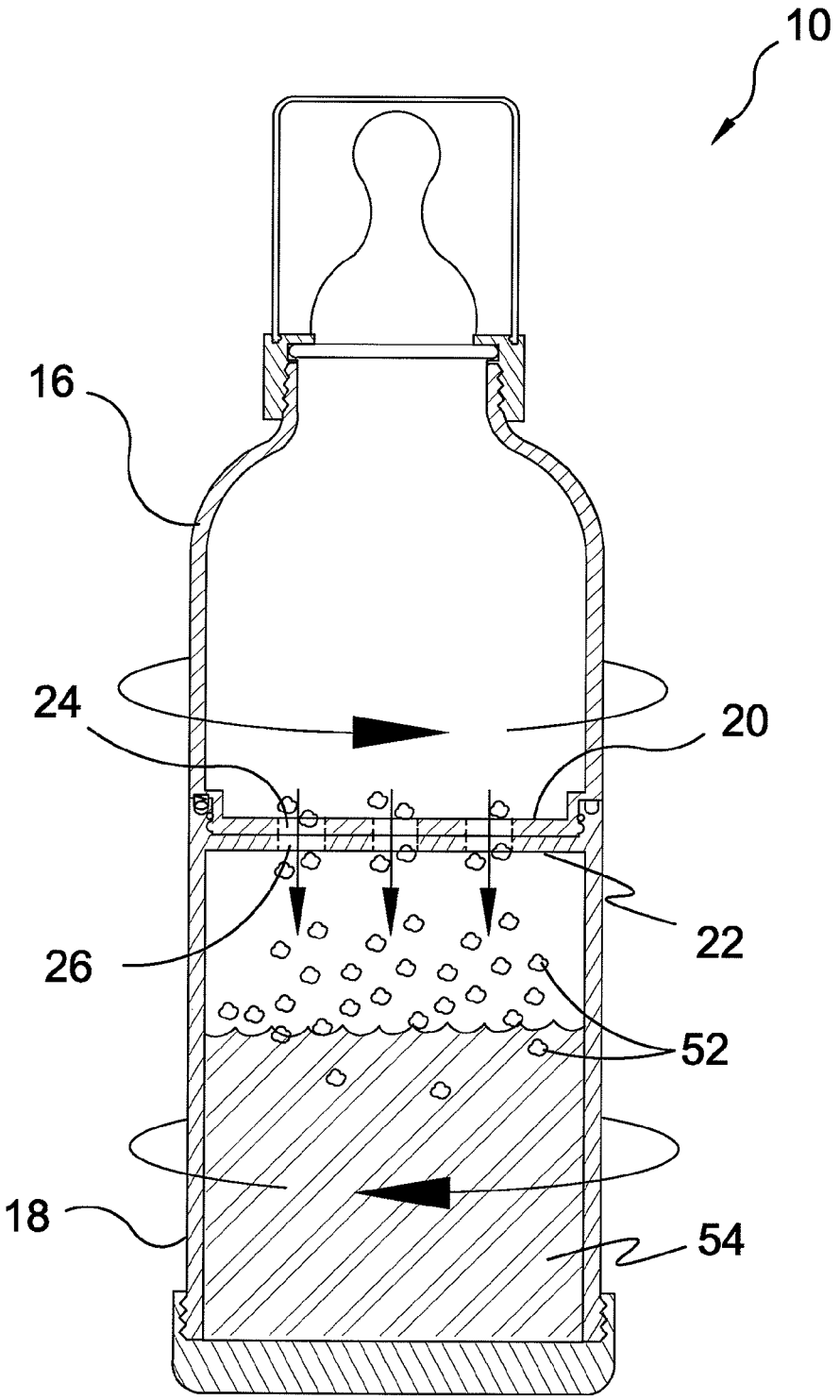
FIG. 2C is a sectional view of the first design of the present invention in an open position.

FIG. 2C is a sectional view of the first design of the present invention 10 with the upper chamber 16 and lower chamber 18 rotated to an open position. Shown are the lower seal apertures 26 of the lower seal 22 aligned with the upper seal apertures 24 of the upper seal 20 thereby enabling the dry food formula 52 from the upper chamber 16 to mix with the fluid 54 in the lower chamber 18.

Figure 2D:
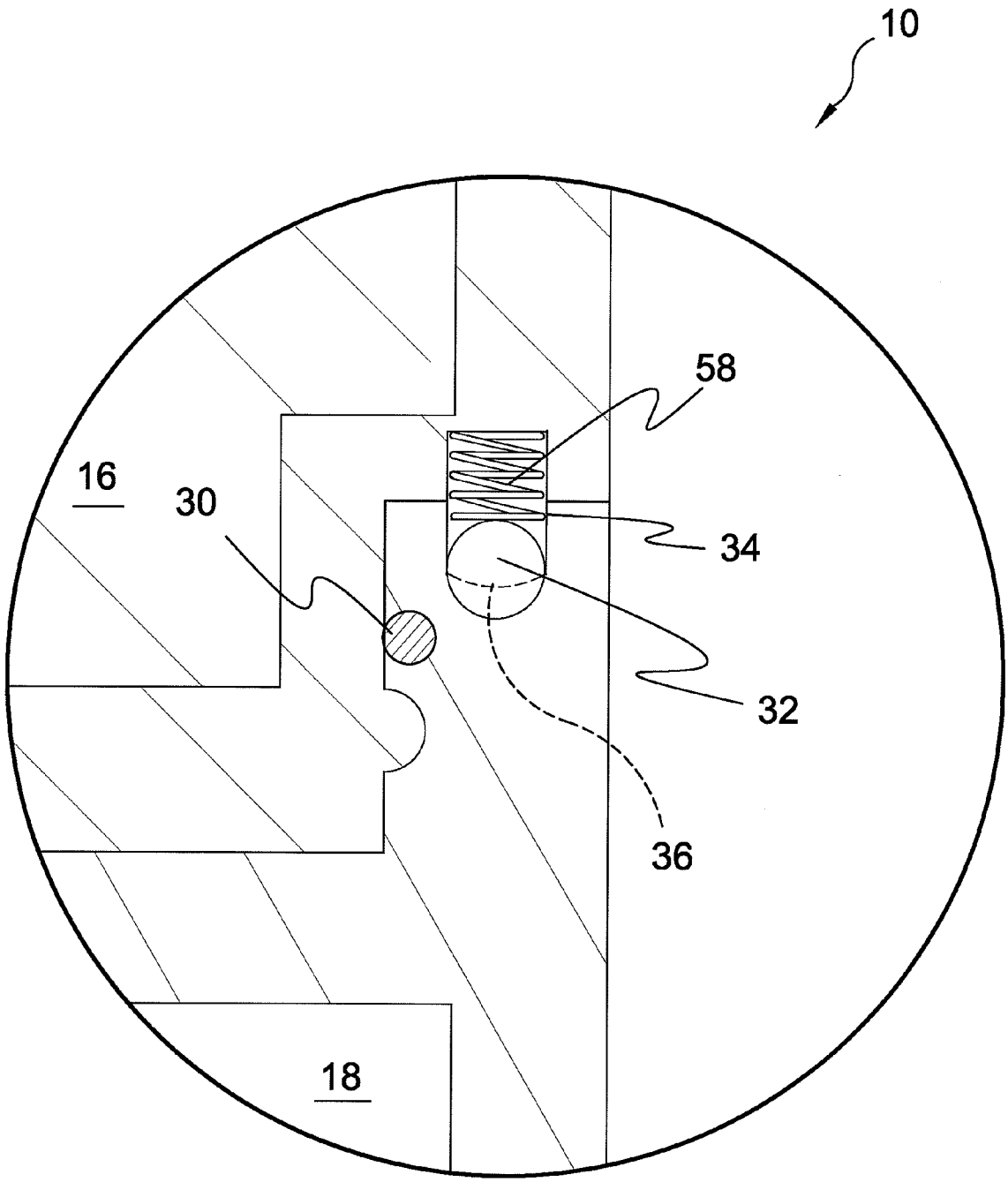
FIG. 2D is a detailed view of the first design of the present invention in a closed position.

FIG. 2D is a detailed view of the first design of the present invention 10 in a closed position. Shown is a detail view of the first design of the present invention, showing the o-ring 30, and the spring pin 32 captive within the spring pin lock port 34 due to the bias presented by a pin spring 58 prior to rotation. The upper seal apertures are not in alignment to the lower seal apertures, preventing the formula in the upper chamber 16 from mixing with the water in the lower chamber 18. The spring pin lock port on opposite side of the bottle, is designed with a somewhat concave lip 36 which allows the spring pin to leave the port when a forced opposite twist is applied, and allowing the mixing apertures back to a closed position.

Figure 2E:
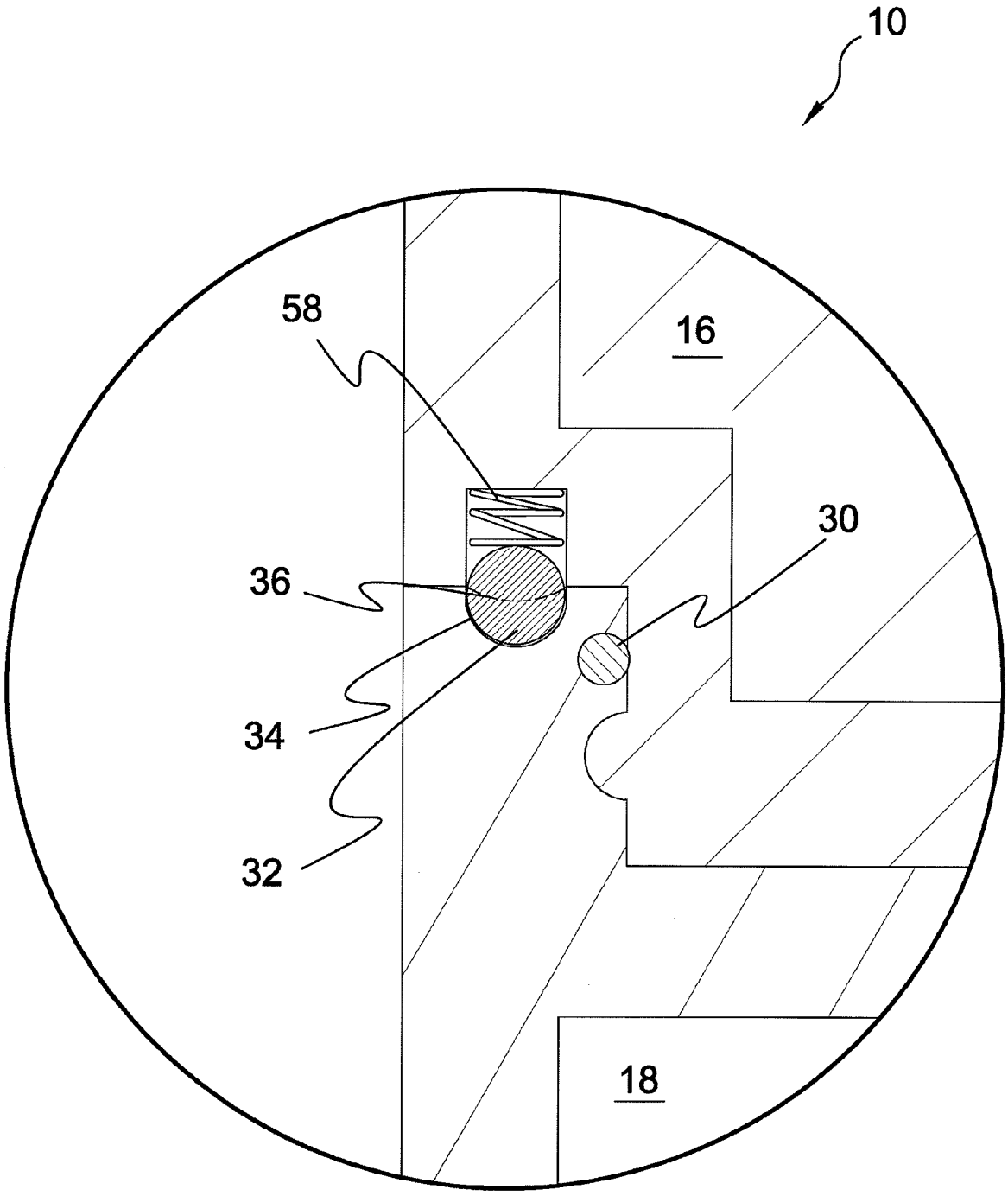
FIG. 2E is a detailed view of the first design of the present invention in an open position.

FIG. 2E is a detailed view of the first design of the present invention 10 in an open and locked position. Shown is a detail view of the first design of the present invention, showing the o-ring 30, and the chambers twisted to a point where the spring pin 32 popped into the lock port 34 by the spring 58, allowing the upper seal apertures align to the lower seal apertures to allow the formula in the upper chamber 16 to mix with the water in the lower chamber 18. This is achieved by twisting the top portion to the right while twisting the lower portion to the left, allowing the spring pin 32 to travel along until it pops into the spring lock port 34, aligning the apertures and allowing the formula to mix with the water. The spring pin lock port 34 is designed with a somewhat concave lip 36 which allows the spring pin 32 to leave the port 34 when a forced opposite twist is applied, and allowing the mixing apertures back to a closed position.

Figure 2F:
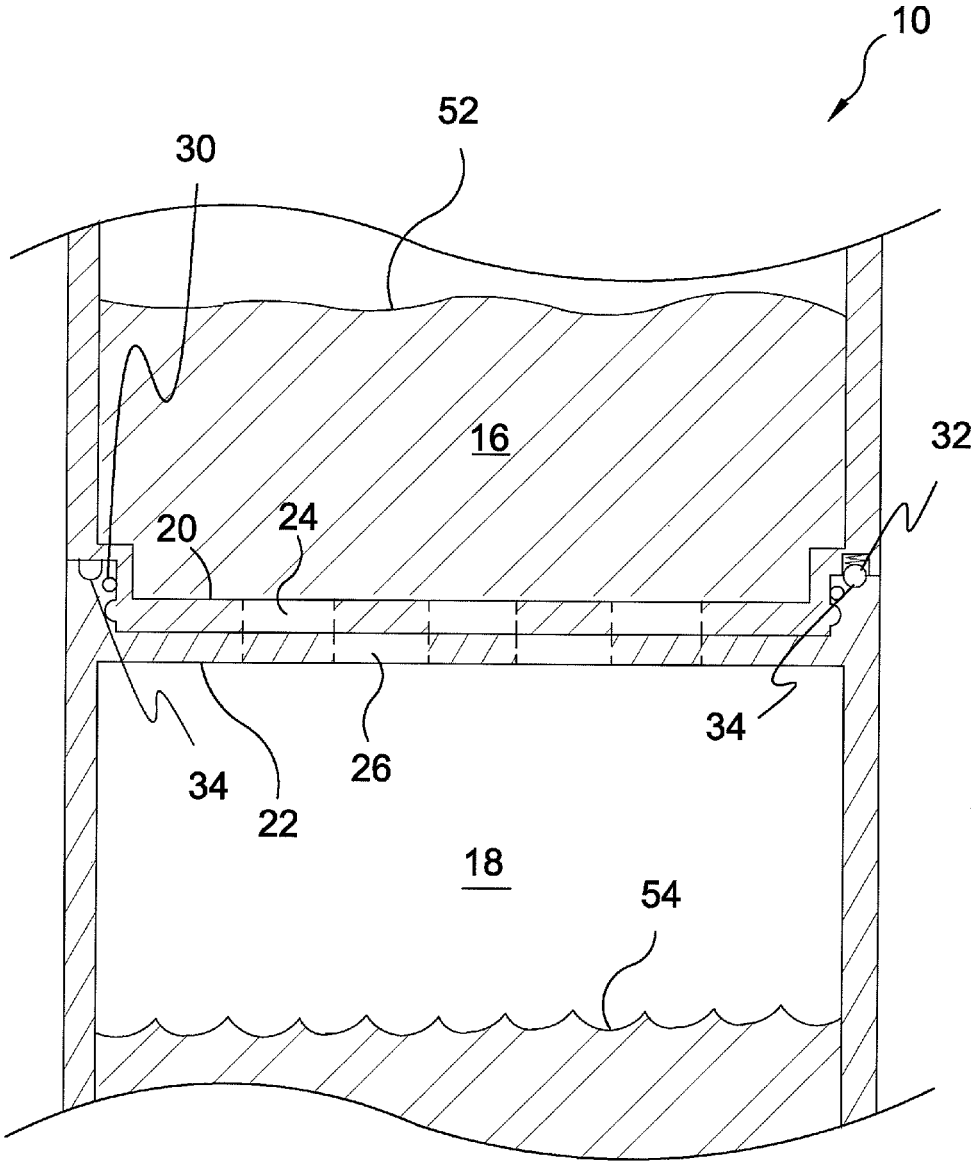
FIG. 2F is a partial sectional view of the first design of the present invention in a closed position.

FIG. 2F is a partial sectional view of the first design of the present invention 10 in a closed position prior to rotation. Shown is a partial sectional view of the first design of the present invention, a dual chambered baby bottle 10 having an upper chamber 16, a lower chamber 18, an upper seal 20, a lower seal 22 adjacent the upper seal 20, a plurality of upper seal apertures 24 in the upper seal 20, and a plurality of lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 nonaligned. An o-ring 30 is included. In using the present invention, first a liquid 54 is placed into the lower chamber 18, then the upper seal 20 and lower seal 22 are rotated to a closed position and a dry food 52 is placed into the upper chamber 16. When the user is ready to mix the liquid 54 with the dry food 52, the upper seal 20 and the lower seal 22 are rotated to an open position and the dry food 52 is mixed with the liquid 54. In a preferred embodiment of the invention, the dry food is powdered infant formula and the liquid is water.

Optionally, the upper seal 20 can further comprise a spring pin 32 and a spring pin lock port 34, the spring pin 32 and the spring pin lock port 34 adapted such that the spring pin 32 pops into the spring pin lock port 34 when the upper seal apertures 24 and the lower seal apertures 26 are aligned.

Figure 2G:
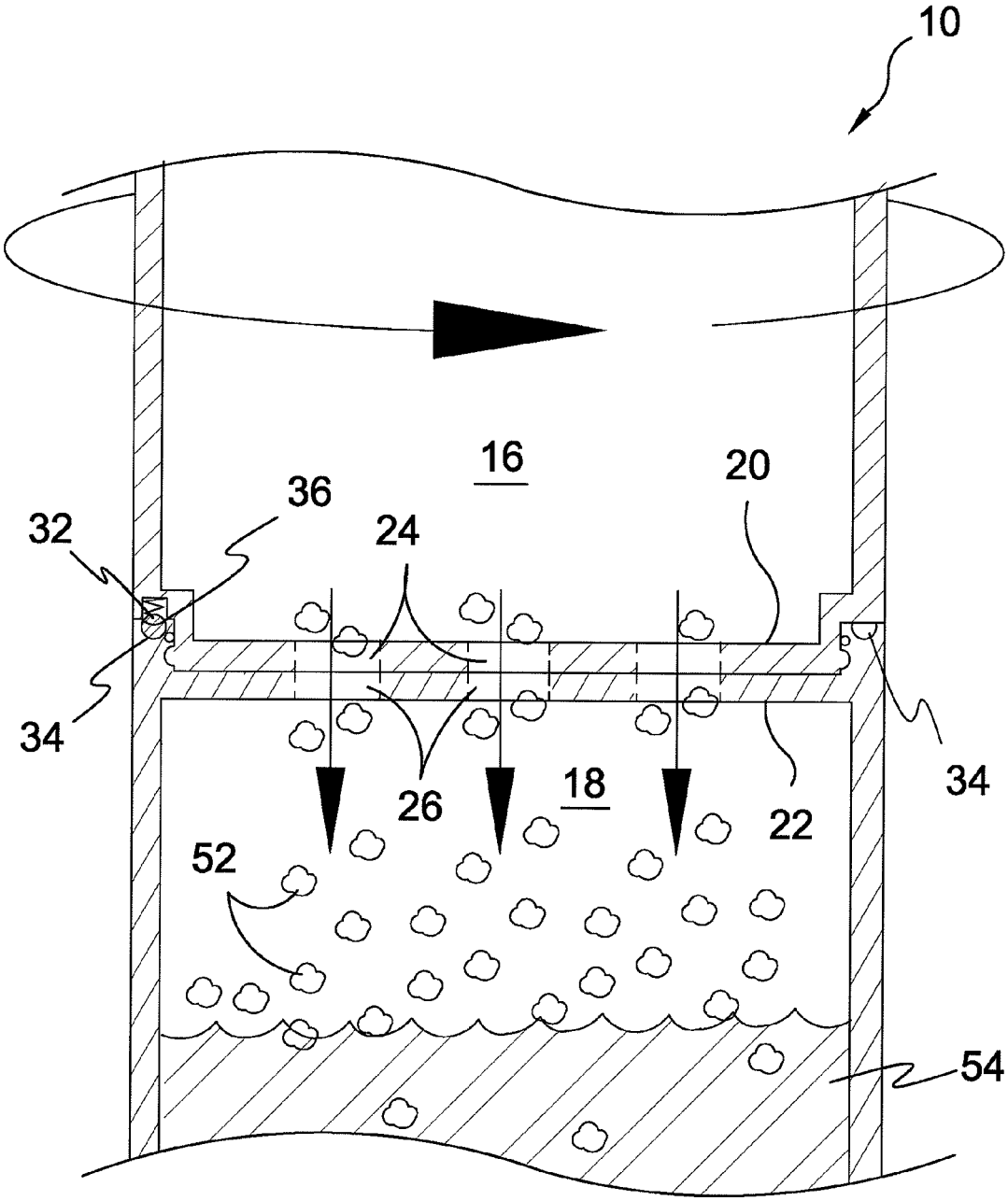
FIG. 2G is a partial sectional view of the first design of the present invention in an open position.

FIG. 2G is a partial sectional view of the first design of the present invention 10 after being rotated to an open position. Shown is a partial sectional view of the first design of the present invention, a dual chambered baby bottle 10 having an upper chamber 16, a lower chamber 18, an upper seal 20, a lower seal 22 adjacent the upper seal 20, a plurality of upper seal apertures 24 in the upper seal 20, and a plurality of lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 nonaligned. In using the present invention, first a liquid is placed into the lower chamber 18, then the upper seal 20 and lower seal 22 are rotated to a closed position and a dry food is placed into the upper chamber 16. When the user is ready to mix the liquid 54 with the dry food 52, the upper seal 20 and the lower seal 22 are rotated to an open position and the dry food 52 is mixed with the liquid 54. In a preferred embodiment of the invention, the dry food is powdered infant formula and the liquid is water.

Optionally, the upper seal 20 can further comprise a spring pin 32 and a spring pin lock port 34, the spring pin 32 and the spring pin lock port 34 adapted such that the spring pin 32 pops into the spring pin lock port 34 when the upper seal apertures 24 and the lower seal apertures 26 are aligned. The spring pin lock port 34 further comprises a concave lip 36.

Figure 2H:
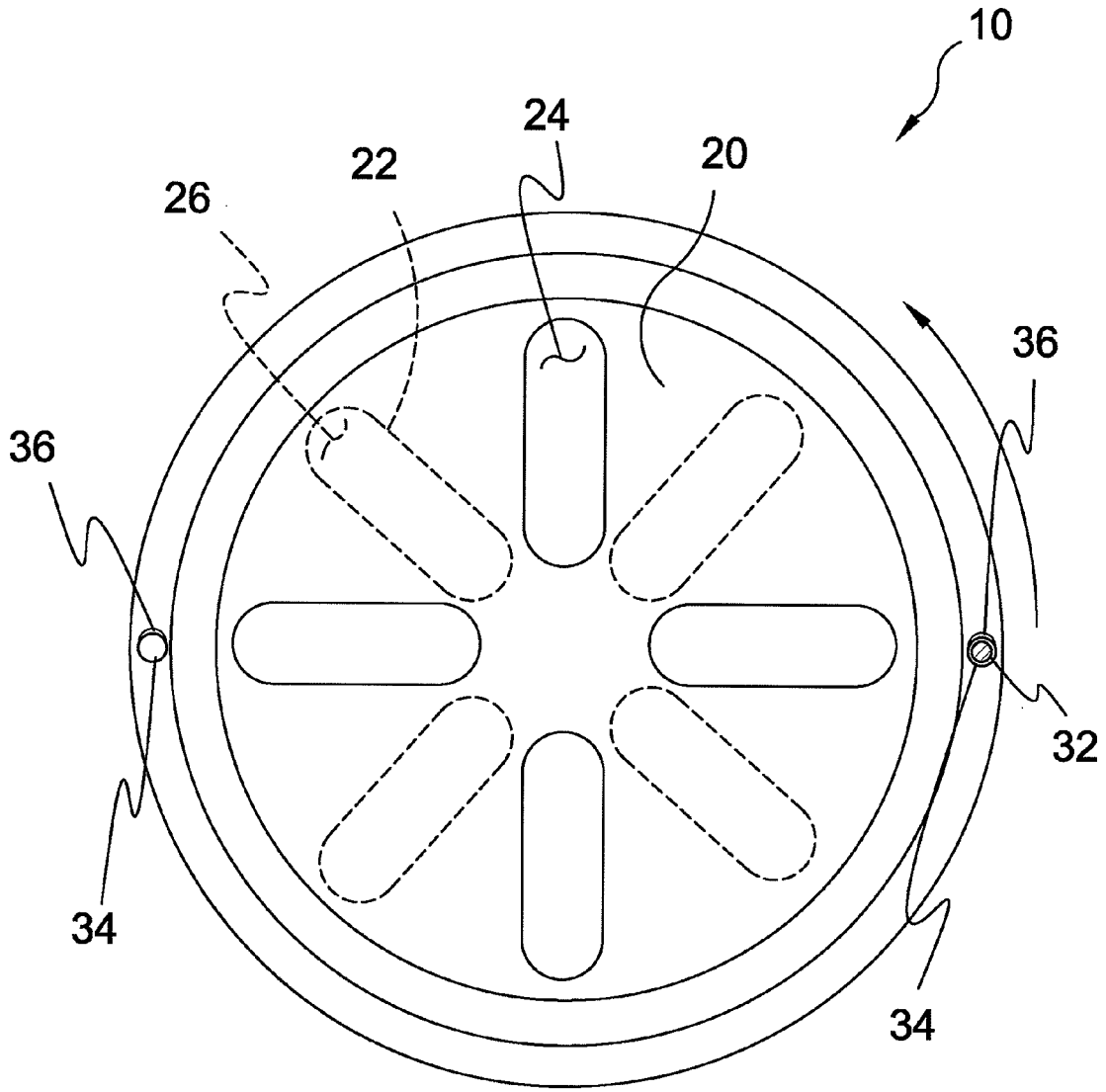
FIG. 2H is a sectional view of the first design of the present invention in a closed position.

FIG. 2H is a sectional view of the first design of the present invention 10 in a closed position prior to rotation with the upper seal apertures 24 and the bottom seal apertures 26 nonaligned. Shown is a sectional view of the first design of the present invention, a dual chambered baby bottle 10 having an upper chamber, a lower chamber, an upper seal 20, a lower seal 22 adjacent the upper seal 20, a plurality of upper seal apertures 24 in the upper seal 20, and a plurality of lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 nonaligned. In using the present invention, first a liquid is placed into the lower chamber, then the upper seal 20 and lower seal 22 are rotated to a closed position and a dry food is placed into the upper chamber. When the user is ready to mix the liquid with the dry food, the upper seal 20 and the lower seal 22 are rotated to an open position and the dry food is mixed with the liquid. In a preferred embodiment of the invention, the dry food is powdered infant formula and the liquid is water.

Optionally, the upper seal 20 can further comprise a spring pin 32 and a spring pin lock port 34, the spring pin 32 and the spring pin lock port 34 adapted such that the spring pin 32 pops into the spring pin lock port 34 when the upper seal apertures 24 and the lower seal apertures 26 are aligned. The spring pin lock port 34 further comprises a concave lip 36.

Figure 2I:
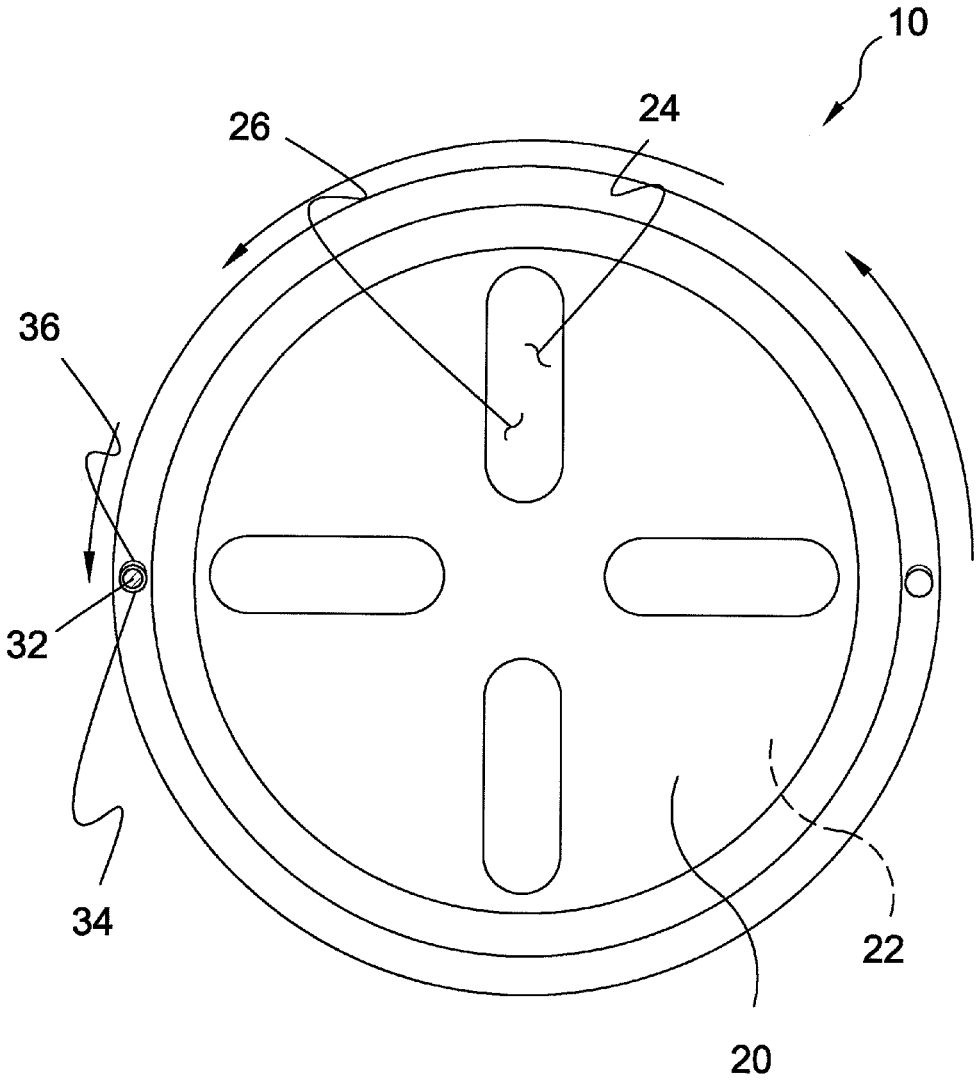
FIG. 2I is a sectional view of the first design of the present invention in an open position.

FIG. 2I is a sectional view of the first design of the present invention rotated to an open position. Shown is a sectional view of the first design of the present invention, a dual chambered baby bottle 10 having an upper chamber, a lower chamber, an upper seal 20, a lower seal 22 subjacent the upper seal 20, a plurality of upper seal apertures 24 in the upper seal 20, and a plurality of corresponding lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 nonaligned. In using the present invention, first a liquid is placed into the lower chamber, then the upper seal 20 and lower seal 22 are rotated to a closed position and a dry food is placed into the upper chamber. When the user is ready to mix the liquid with the dry food, the upper seal 20 and the lower seal 22 are rotated to an open position and the dry food is mixed with the liquid. In a preferred embodiment of the invention, the dry food is powdered infant formula and the liquid is water.

Optionally, the upper seal 20 can further comprise a spring pin 32 and a spring pin lock port 34, the spring pin 32 and the spring pin lock port 34 adapted such that the spring pin 32 pops into the spring pin lock port 34 when the upper seal apertures 24 and the lower seal apertures 26 are aligned. The spring pin lock port 34 further comprises a concave lip 36.

Figure 2J:
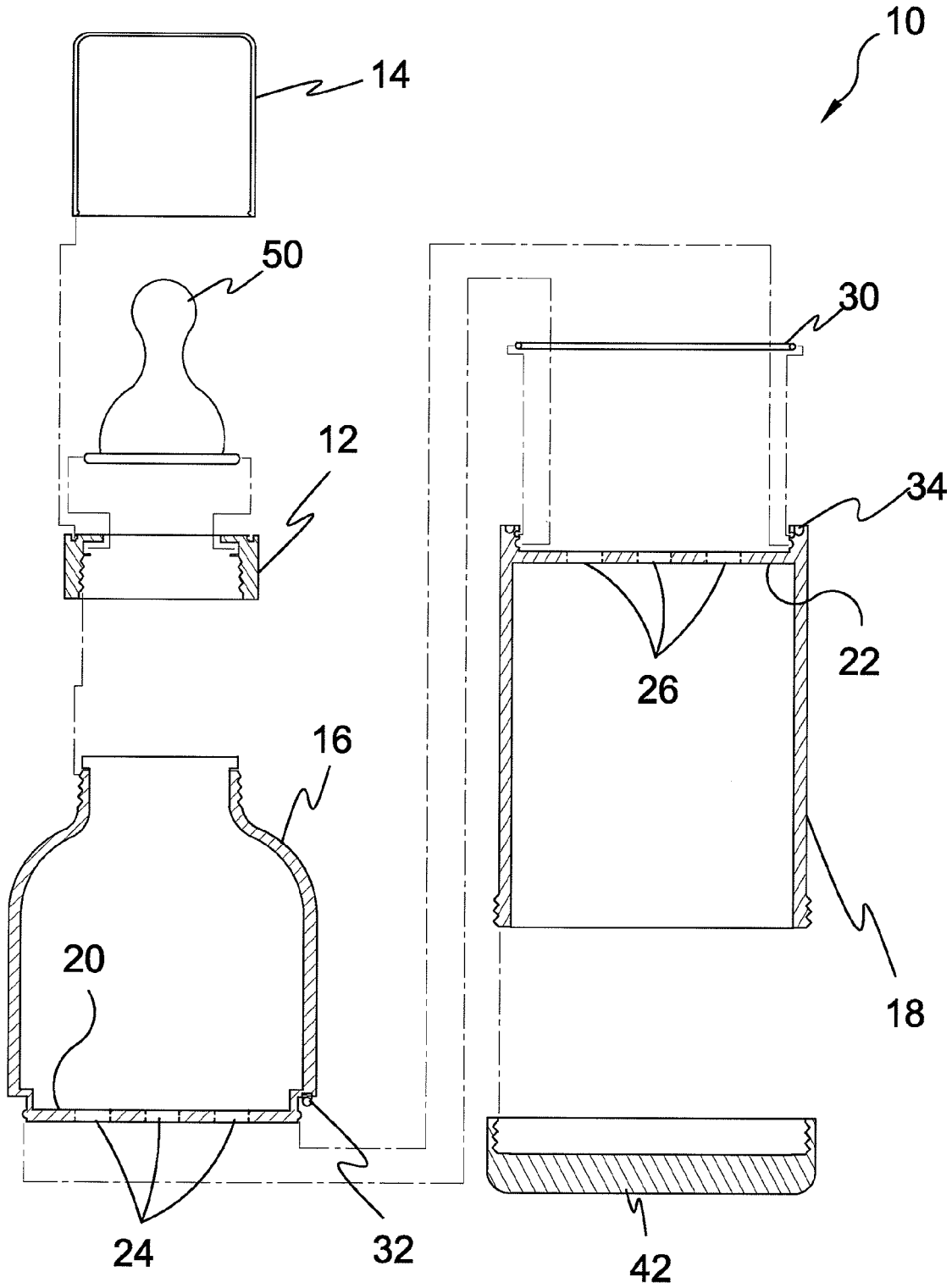
FIG. 2J is an exploded view of the first design of the present invention.

FIG. 2J is an exploded view of the first design of the present invention 10. Shown is an exploded view of the first design of the present invention, a dual chambered baby bottle 10 having a threaded nipple top 12 with nipple 50, a plastic cover 14 for the threaded nipple top 12, an upper chamber 16 in fluid communication with the nipple top 12, a lower chamber 18, an upper seal 20 forming a lower portion of the upper chamber, a lower seal 22 adjacent the upper seal 20, the lower seal 22 forming an upper portion of the lower chamber, a plurality of upper seal apertures 24 in the upper seal 20, and a plurality of lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 nonaligned. This is achieved by twisting the top portion to the right while twisting the lower portion to the left, allowing the spring pin 32 to travel along until it pops into the spring lock port 34, aligning the apertures and allowing the formula to mix with the water. The spring pin lock port 34 is designed with a somewhat concave lip which allows the spring pin 32 to leave the port 34 when a forced opposite twist is applied, and allowing the mixing apertures back to a closed position. In using the present invention, first a liquid is placed into the lower chamber 18, then the upper seal 20 and lower seal 22 are rotated to a closed position and a dry food is placed into the upper chamber 16. The bottle 10 is sealed by affixing the threaded nipple top 12. When the user is ready to mix the liquid with the dry food, the upper seal 20 and the lower seal 22 are rotated to an open position and the dry food is mixed with the liquid. In a preferred embodiment of the invention, the dry food is powdered baby formula and the liquid is water. A screw-on bottom 42 and o-ring 30 are affiliated with the lower chamber 18.

Optionally, the upper seal 22 further comprises an o-ring 30. The upper seal 20 can further comprise a spring pin 32 and a spring pin lock port 34, the spring pin 32 and the spring pin lock port 34 adapted such that the spring pin 32 pops into the spring pin lock port 34 when the upper seal apertures 24 and the lower seal apertures are aligned. The dual chamber baby bottle 10 of the present invention can further include a screw-on bottom 42.

Figure 3A:
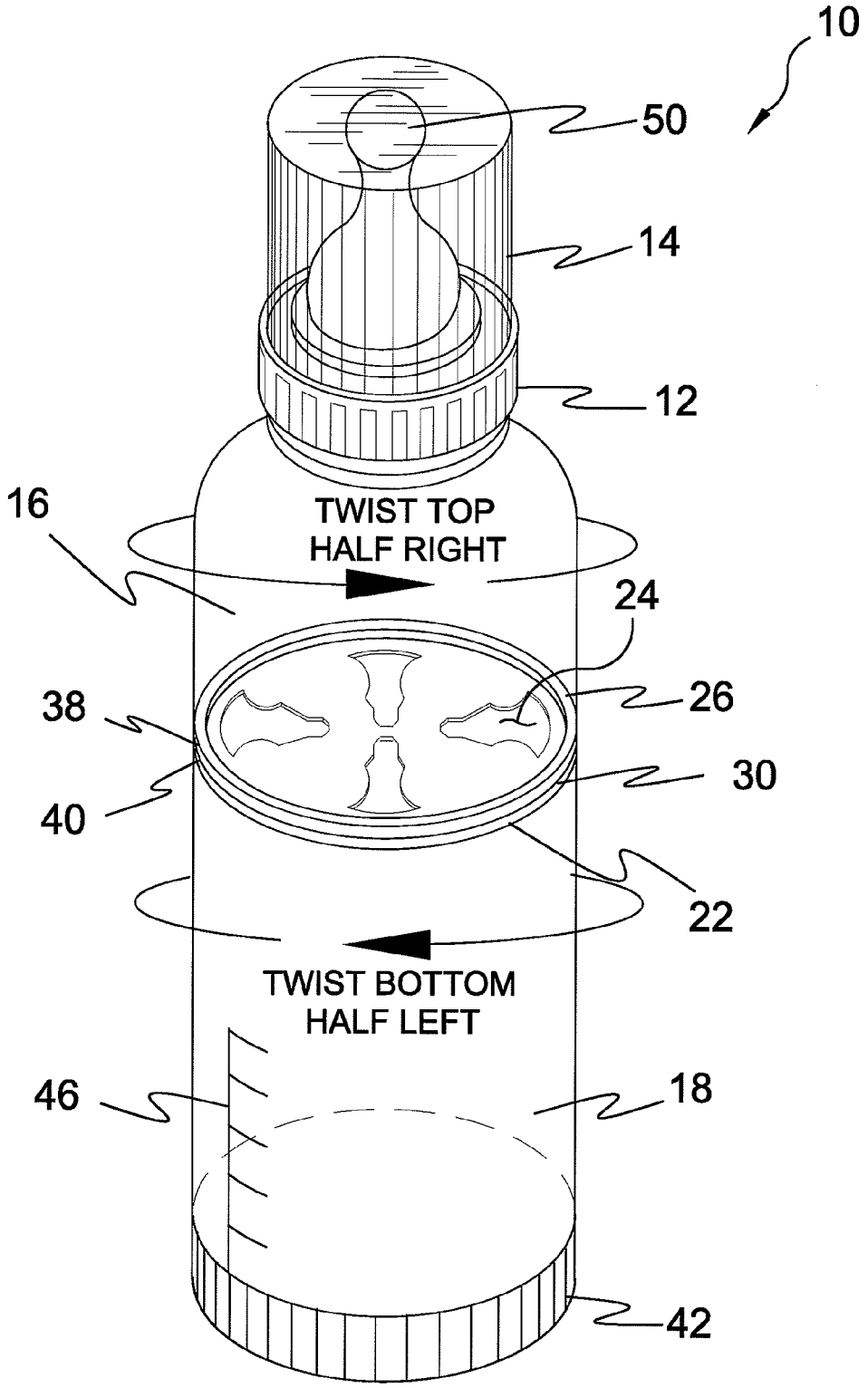
FIG. 3A is a perspective view of a second design of the present invention.

FIG. 3A is a perspective view of a second design of the present invention 10. Shown is a second design of the present invention, a dual chambered baby bottle 10 having a threaded nipple top 12 with nipple, a plastic cover 14 for the threaded nipple top 12, an upper chamber 16 in fluid communication with the nipple top 12, a lower chamber 18, an upper seal 20 forming a lower portion of the upper chamber, a lower seal 22 adjacent the upper seal 20, the lower seal 22 forming an upper portion of the lower chamber, a plurality of upper seal apertures 24 in the upper seal 20, and a plurality of lower seal apertures in the lower seal 22, the upper seal 20 and lower seal 22 rotatable between an open position with the upper seal apertures 24 and the lower seal apertures aligned and a closed position with the upper seal apertures 24 and the lower seal apertures nonaligned. This is achieved by twisting the top portion to the right while twisting the lower portion to the left. In using the present invention, first a liquid is placed into the lower chamber 18, then the upper seal 20 and lower seal 22 are rotated to a closed position and a dry food is placed into the upper chamber 16. The bottle 10 is sealed by affixing the threaded nipple top 12. When the user is ready to mix the liquid with the dry food, the upper seal 20 and the lower seal 22 are rotated to an open position and the dry food is mixed with the liquid. In a preferred embodiment of the invention 10, the dry food is powdered baby formula and the liquid is water.

Optionally, the upper seal 22 further comprises an o-ring 30. Shown is the upper seal 20 further comprising a pin 38 and channel 40 through which the pin 38 is adapted to travel. The dual chamber baby bottle 10 of the present invention can further include a screw-on bottom 42 and a measurement scale 46.

Figure 3B:
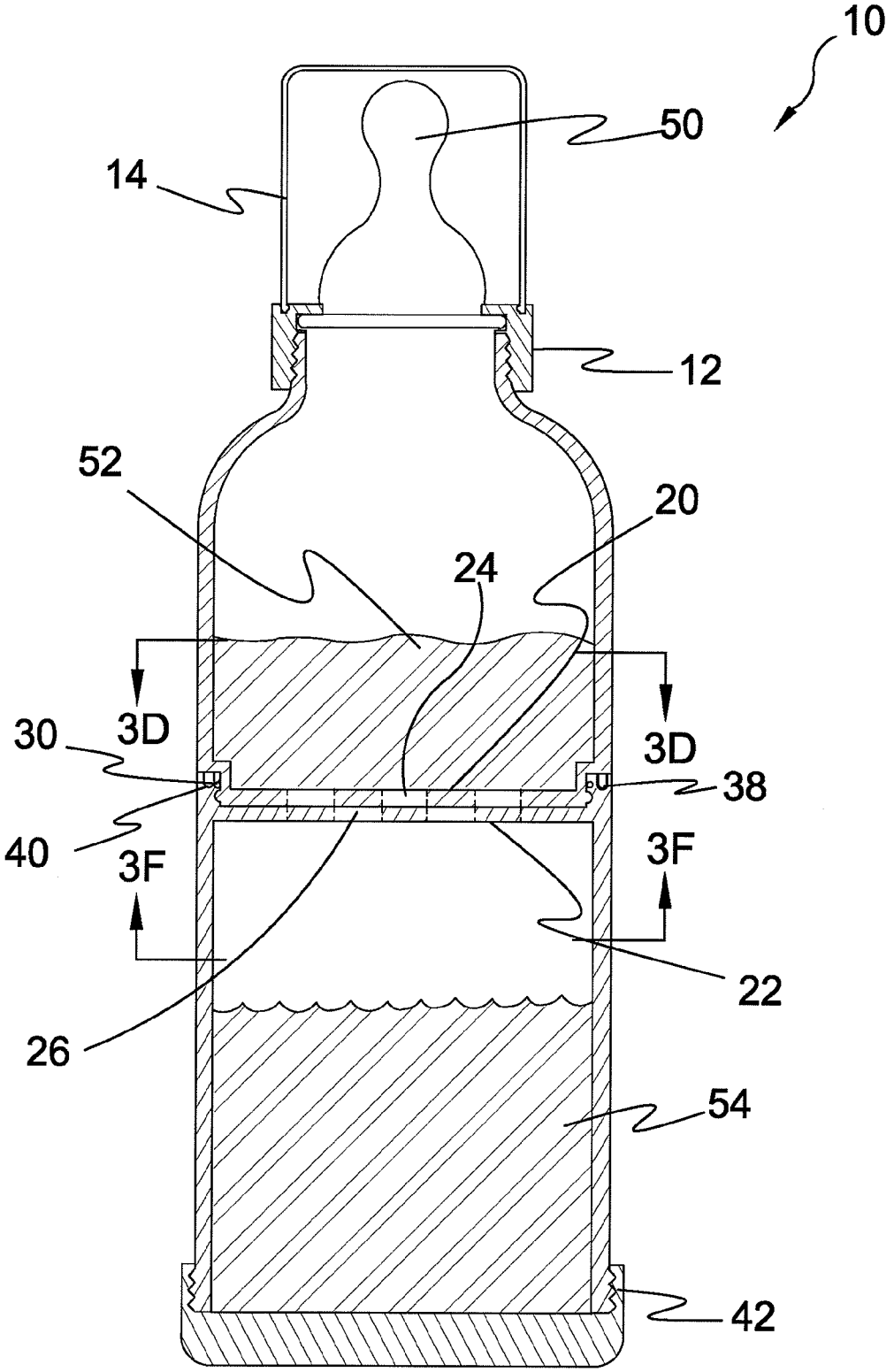
FIG. 3B is a sectional view of the second design of the present invention in a closed position.

FIG. 3B is a sectional view of the second design of the present invention 10 in a closed position prior to rotation. Shown is a second design of the present invention, a dual chambered baby bottle 10 having a threaded nipple top 12 with nipple 50, a plastic cover 14 for the threaded nipple top 12, an upper chamber 16 in fluid communication with the nipple top 12, a lower chamber 18, an upper seal 20 forming a lower portion of the upper chamber, a lower seal 22 adjacent the upper seal 20, the lower seal 22 forming an upper portion of the lower chamber, a plurality of upper seal apertures 24 in the upper seal 20, and a plurality of lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 nonaligned. This is achieved by twisting the top portion to the right while twisting the lower portion to the left. In using the present invention, first a liquid is placed into the lower chamber 18, then the upper seal 20 and lower seal 22 are rotated to a closed position and a dry food is placed into the upper chamber 16. The bottle 10 is sealed by affixing the threaded nipple top 12. When the user is ready to mix the liquid with the dry food, the upper seal 20 and the lower seal 22 are rotated to an open position and the dry food 52 is mixed with the liquid 54. In a preferred embodiment of the invention, the dry food is powdered baby formula and the liquid is water.

Optionally, the upper seal 22 further comprises an o-ring 30. Shown is the upper seal 20 further comprising a pin 38 and channel 40 through which the pin 38 is adapted to travel. The dual chamber baby bottle 10 of the present invention can further include a screw-on bottom 42 and o-ring 30.

Figure 3C:
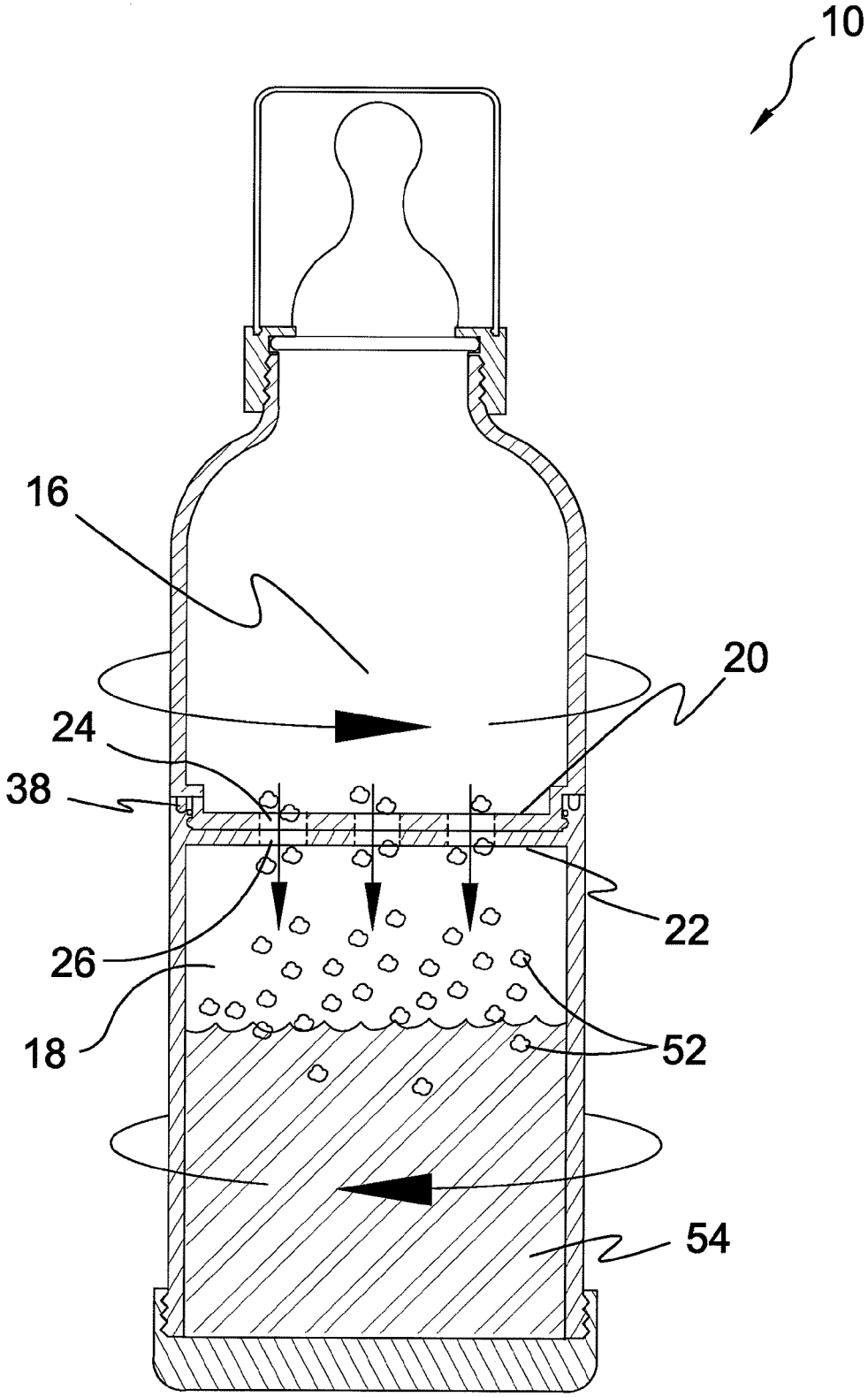
FIG. 3C is a sectional view of the second design of the present invention in an open position.

FIG. 3C is a sectional view of the second design of the present invention 10 rotated to an open position. Shown is a second design of the present invention, a dual chambered baby bottle 10 with the pin 38 rotated and the upper seal apertures 24 of the upper seal 20 aligned with the lower seal apertures 26 to allow for the passage of the powdered formula 52 from the upper chamber 16 into the lower chamber 18 to mix with the fluid 54 contained therein.

Figure 3D:
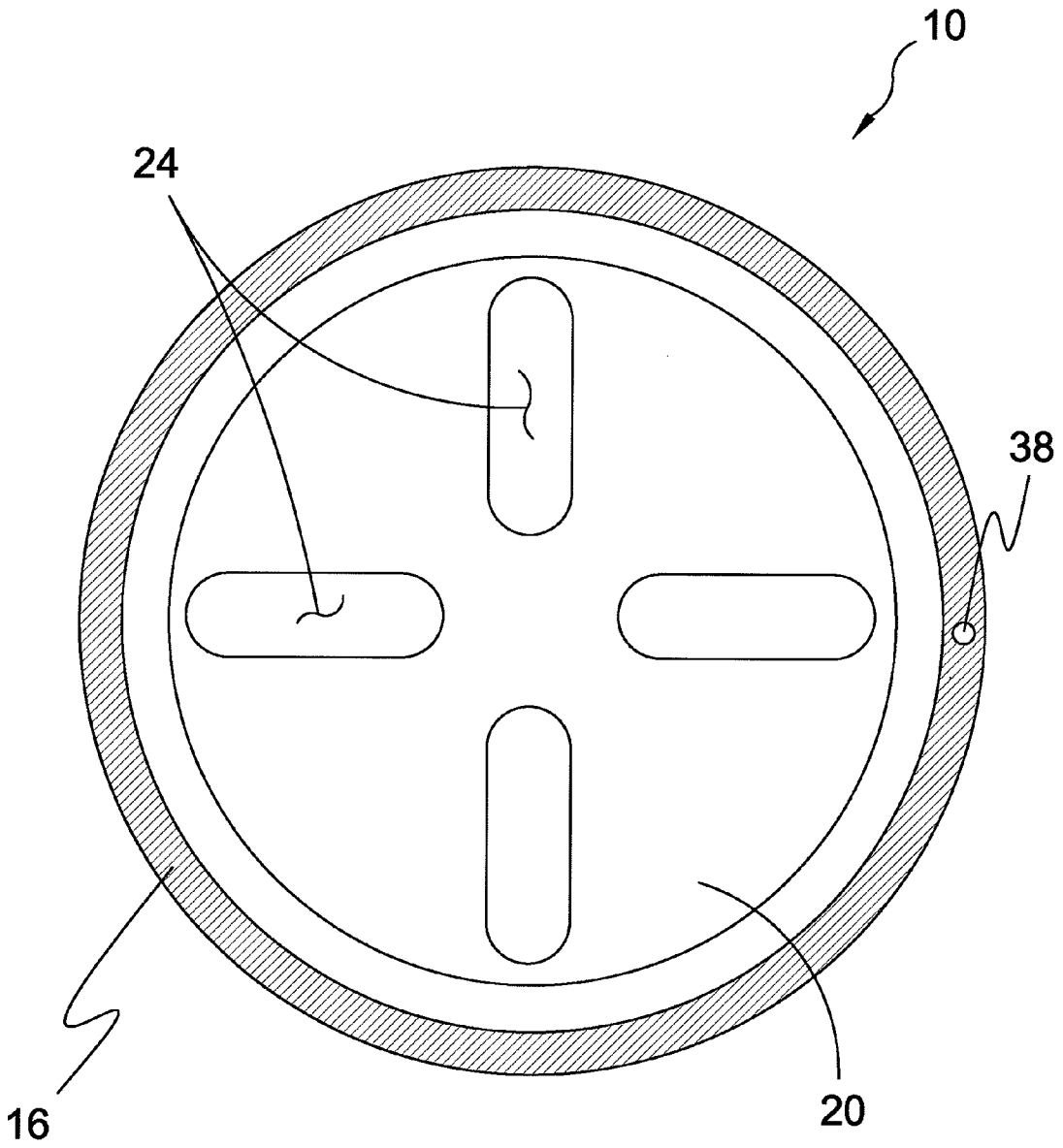
FIG. 3D is a sectional view of the second design of the present inventions upper chamber.

FIG. 3D is a sectional view of the second design of the present inventions 10 upper chamber 16. Shown is the upper seal 20 with its upper seal apertures 24 and the peripheral placement of the pin 38.

Figure 3E:
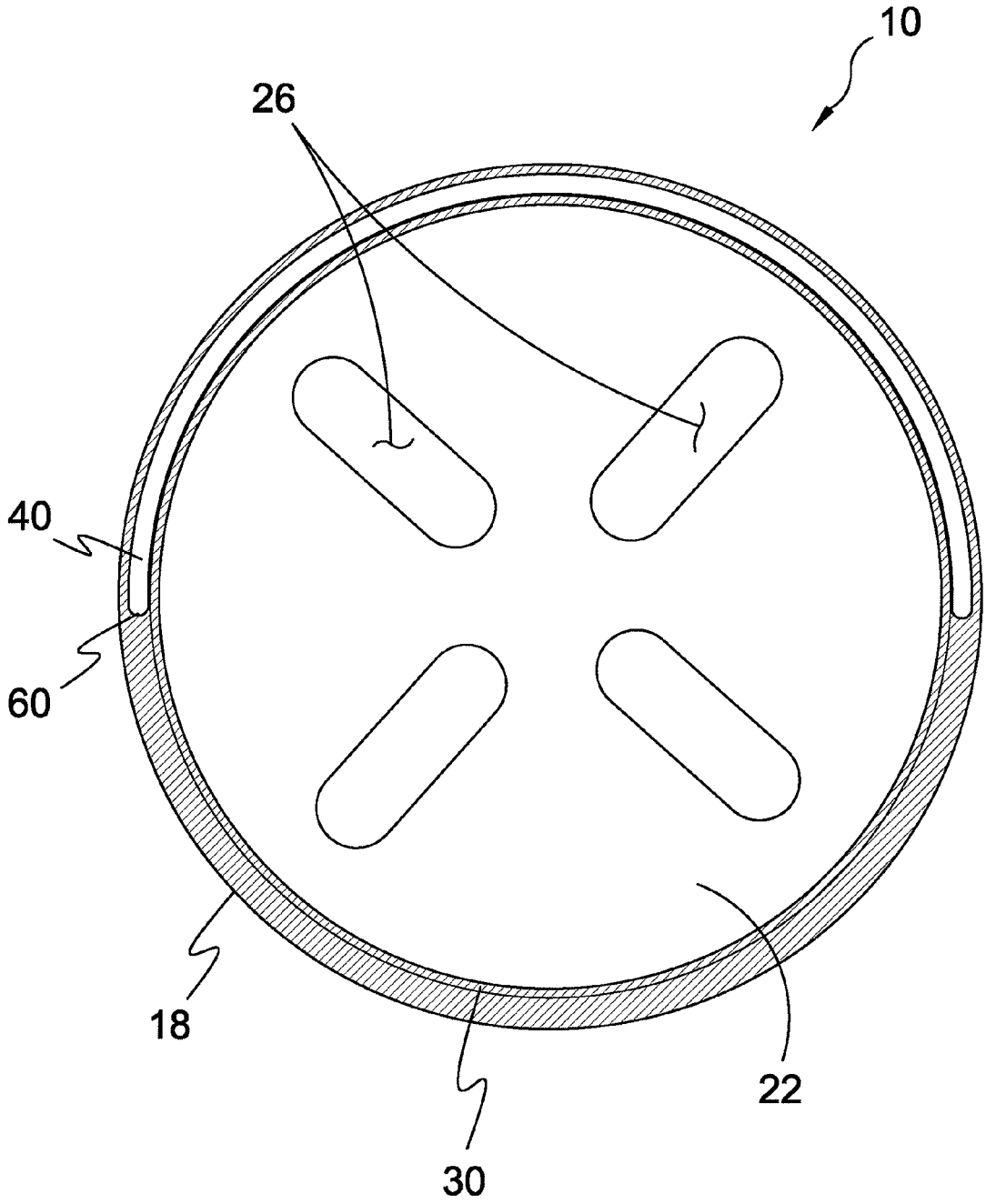
FIG. 3E is a sectional view of the second design of the present inventions lower chamber.

FIG. 3E is a sectional view of the second design of the present invention's lower chamber 18. Shown is the lower seal 22 with a plurality of lower seal apertures 26 further comprising a channel 40 through which the pin is adapted to travel and the pin stop 60 that restricts further rotation of the two chambers upon alignment of the respective apertures. Also shown is the placement of the o-ring 30.

Figure 3F:
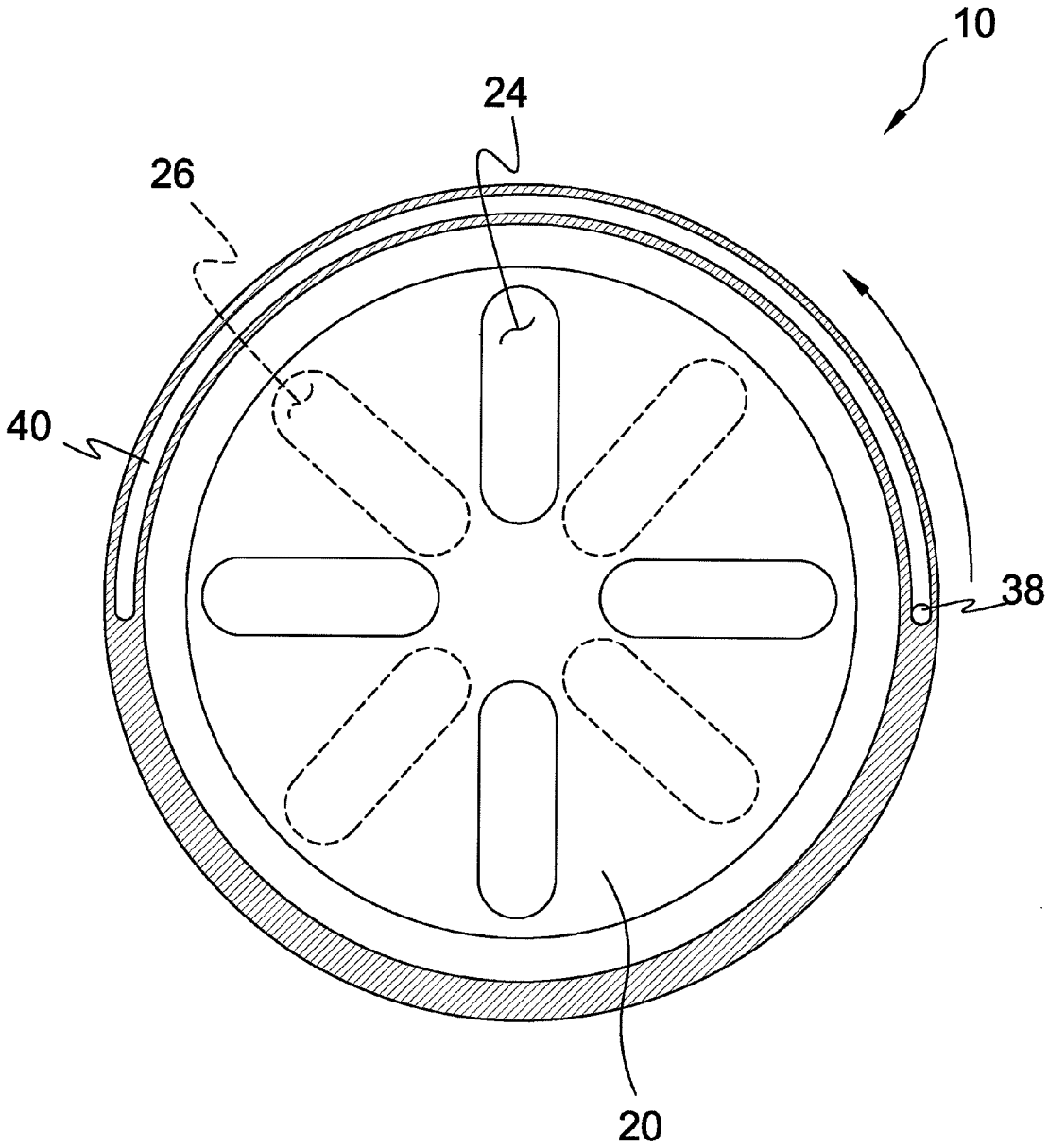
FIG. 3F is a sectional view of the second design of the present inventions upper and lower chambers in a closed position.

FIG. 3F is a sectional view of the second design of the present invention's 10 upper seal apertures 24 and lower seal apertures 26 in the nonaligned closed position. Shown is the upper seal 20 further comprising a pin 38 and channel 40 through which the pin 38 is adapted to travel.

Figure 3G:
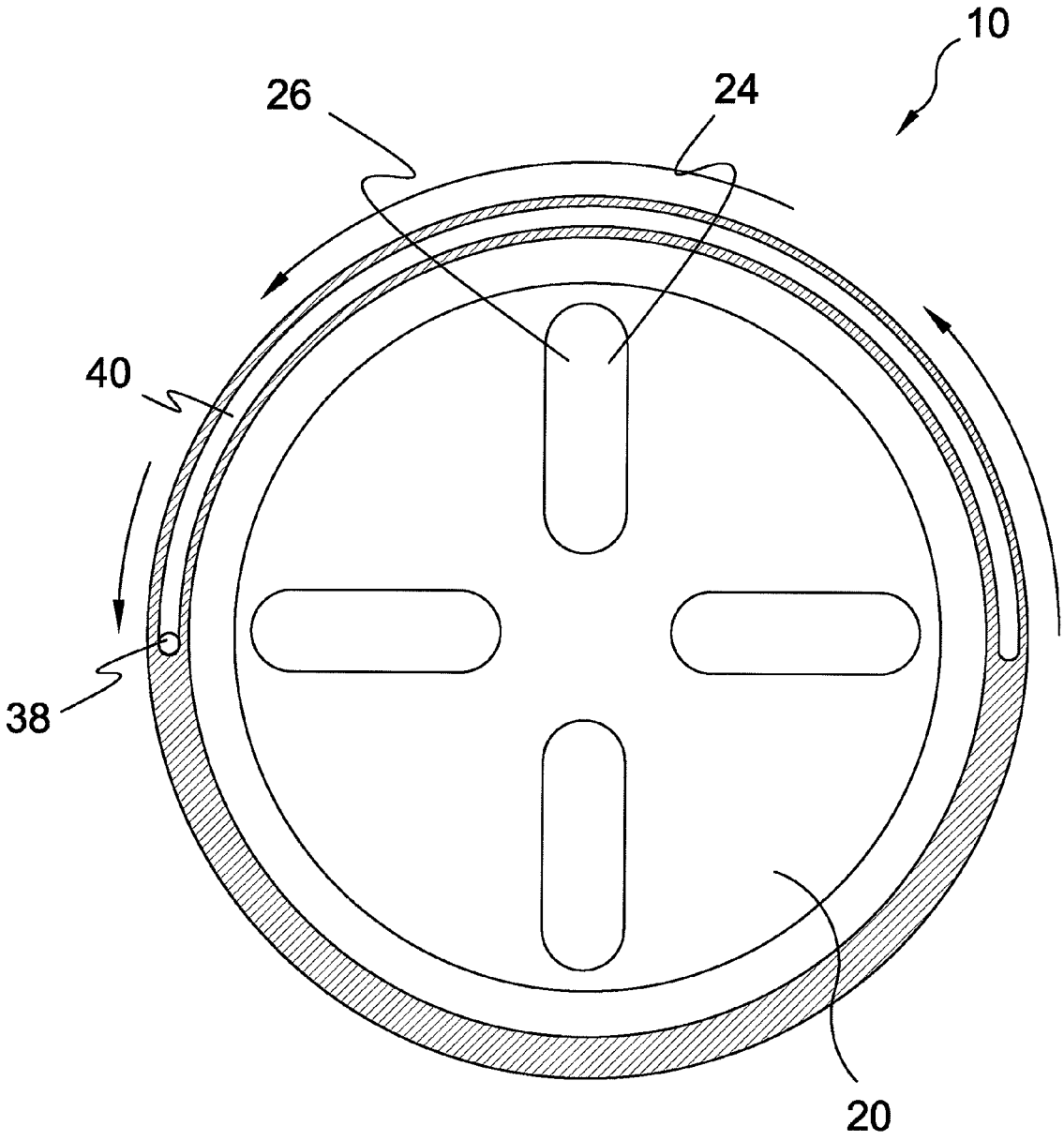
FIG. 3G is a sectional view of the second design of the present inventions upper and lower chambers in an open position.

FIG. 3G is a sectional view of the second design of the present invention's 10 upper seal apertures 24 and lower seal apertures 26 in the aligned open position. Shown is the upper seal 20 further comprising a pin 38 and channel 40 through which the pin 38 is adapted to travel.

Figure 3H:
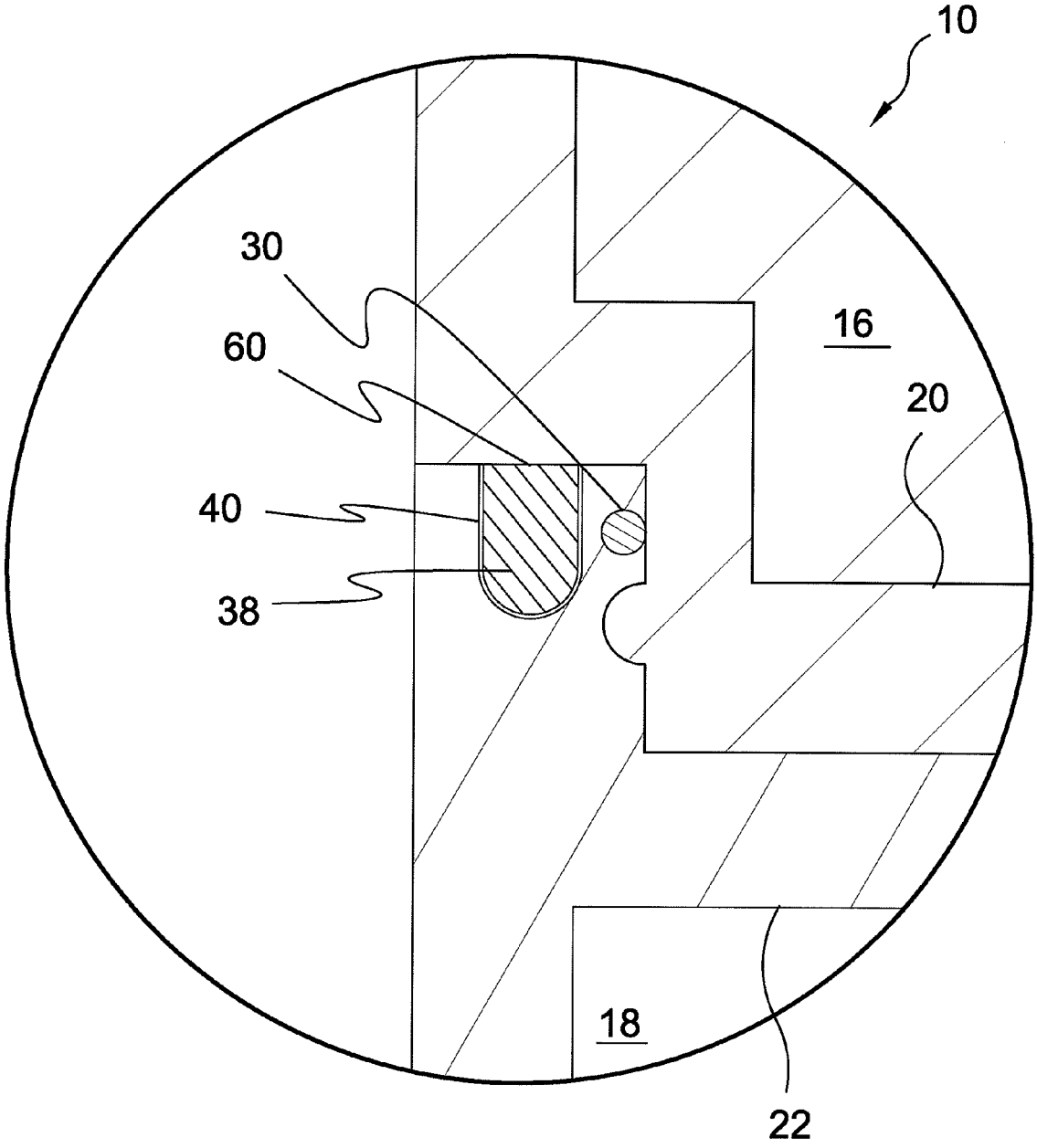
FIG. 3H is a detailed view of the second design of the present inventions upper and lower chambers in an open position.

FIG. 3H is a detailed view of the second design of the present invention's 10 upper 16 and lower 18 chambers in an open position. Shown is a second design of the present invention, a dual chambered baby bottle 10 wherein the upper seal 20 further comprises an o-ring 30. Shown are the lower seal 22 and the upper seal 20 further comprising a pin 38 and channel 40 and pin stop 60 through which the pin 38 is adapted to travel.

Figure 3I:
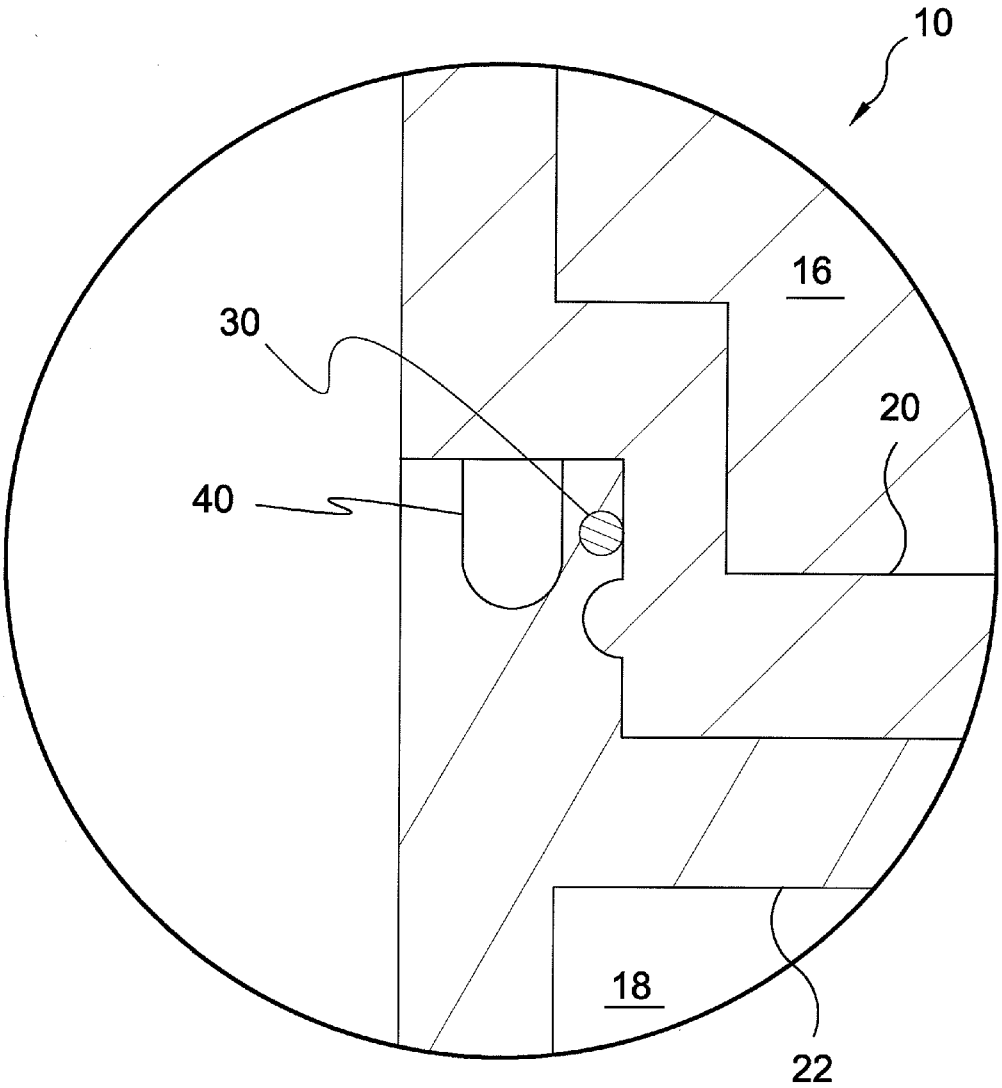
FIG. 3I is a detailed view of the second design of the present inventions upper and lower chambers in a closed position.

FIG. 3I is a detailed view of the second design of the present inventions 10 upper 16 and lower 18 chambers in a closed position. Shown is a second design of the present invention, a dual chambered baby bottle 10 wherein the upper seal 20 further comprises an o-ring 30. Shown are the lower seal 22 and the upper seal 20 further comprising a pin and channel 40 through which the pin is adapted to travel.

Figure 3J:
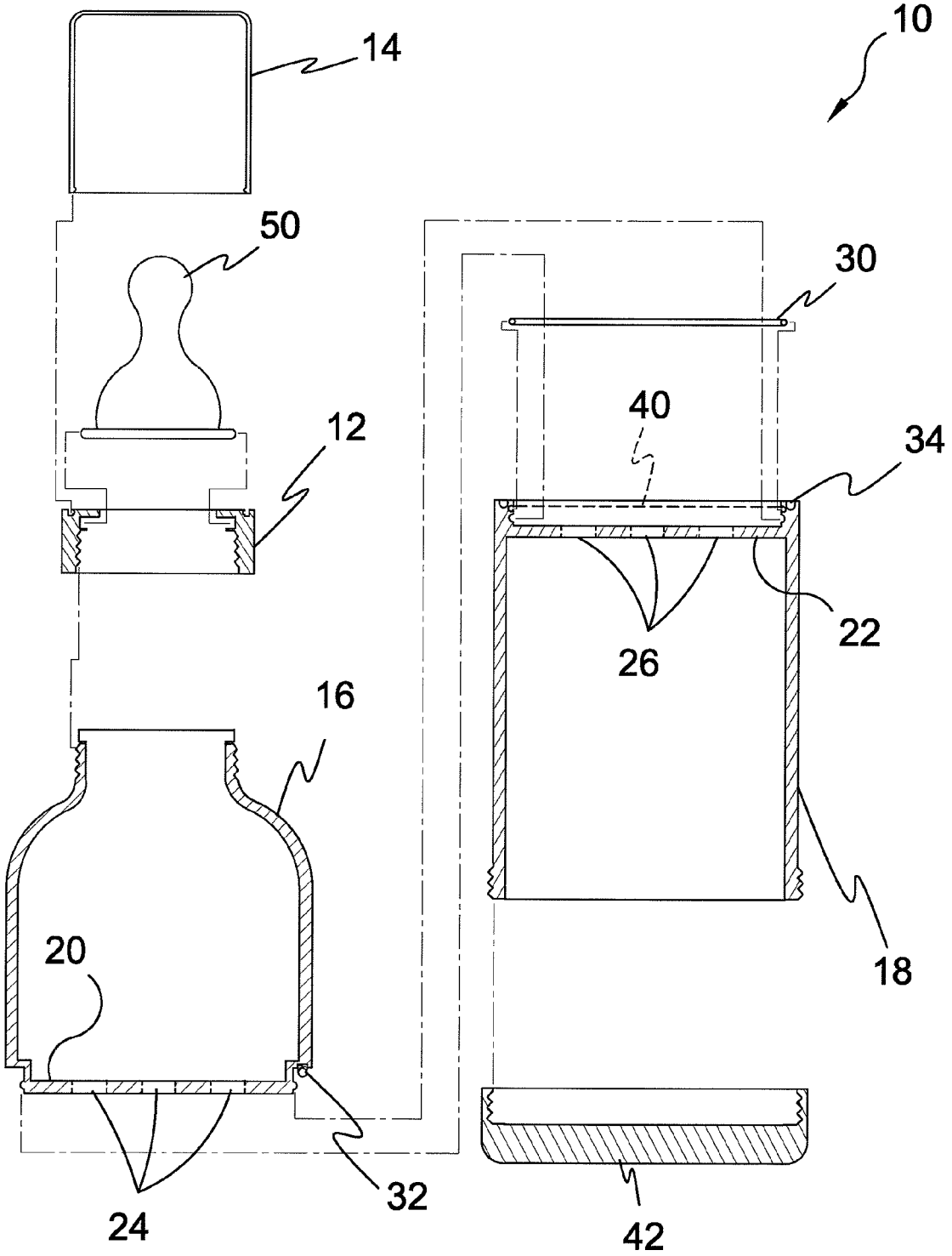
FIG. 3J is an exploded view of the second design of the present invention.

FIG. 3J is an exploded view of the second design of the present invention 10. Shown is an exploded view of the second design of the present invention, a dual chambered baby bottle 10 having a threaded nipple top 12 with nipple 50, a plastic cover 14 for the threaded nipple top 12, an upper chamber 16 in fluid communication with the nipple top 12, a lower chamber 18, an upper seal 20 forming a lower portion of the upper chamber, a lower seal 22 adjacent the upper seal 20, the lower seal 22 forming an upper portion of the lower chamber, a plurality of upper seal apertures 24 in the upper seal 20, and a plurality of lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 nonaligned. This is achieved by twisting the top portion to the right while twisting the lower portion to the left, allowing the spring pin 32 to travel along the channel 40 until it pops into the spring lock port 34, aligning the apertures and allowing the formula to mix with the water. The spring pin lock port 34 is designed with a somewhat concave lip which allows the spring pin 32 to leave the port 34 when a forced opposite twist is applied, and allowing the mixing apertures back to a closed position. In using the present invention, first a liquid is placed into the lower chamber 18, then the upper seal 20 and lower seal 22 are rotated to a closed position and a dry food is placed into the upper chamber 16. The bottle 10 is sealed by affixing the threaded nipple top 12. When the user is ready to mix the liquid with the dry food, the upper seal 20 and the lower seal 22 are rotated to an open position and the dry food is mixed with the liquid. In a preferred embodiment of the invention, the thy food is powdered baby formula and the liquid is water.

Optionally, the upper seal 22 further comprises an o-ring 30. The upper seal 20 can further comprise a spring pin 32 and a spring pin lock port 34, the spring pin 32 and the spring pin lock port 34 adapted such that the spring pin 32 pops into the spring pin lock port 34 when the upper seal apertures 24 and the lower seal apertures are aligned. The dual chamber baby bottle 10 of the present invention can further include a screw-on bottom 42.

Figure 4A:
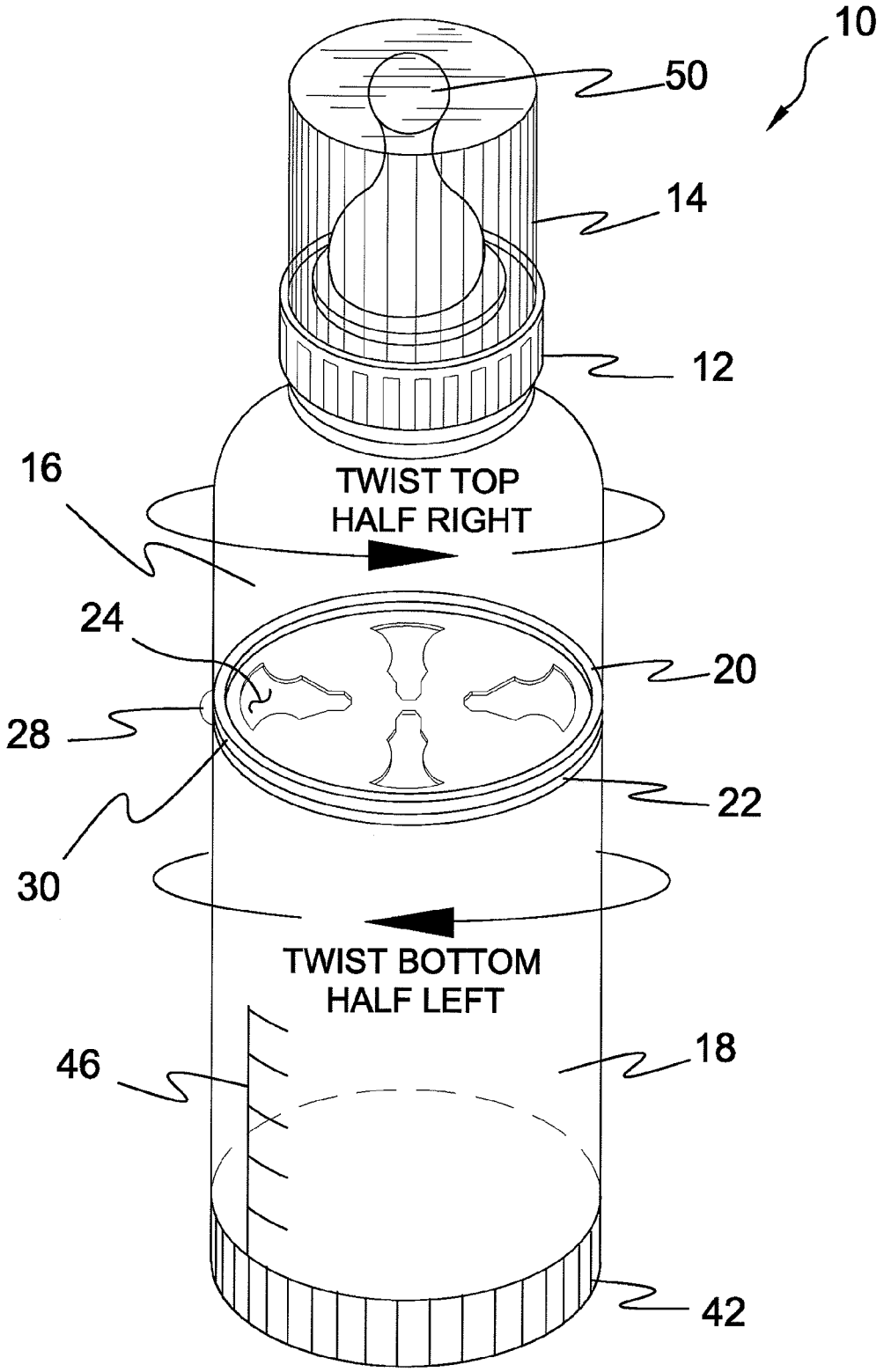
FIG. 4A is a perspective view of the third design of the present invention.

FIG. 4A is a perspective view of the third design of the present invention 10. Shown is a perspective view of the third design of the present invention, a dual chambered baby bottle 10 having a threaded nipple top 12 with nipple 50, a plastic cover 14 for the threaded nipple top 12, an upper chamber 16 in fluid communication with the nipple top 12, a lower chamber 18, an upper seal 20 forming a lower portion of the upper chamber, a lower seal 22 adjacent the upper seal 20, the lower seal 22 forming an upper portion of the lower chamber, a plurality of upper seal apertures 24 in the upper seal 20, and a plurality of lower seal apertures in the lower seal 22, the upper seal 20 and lower seal 22 rotatable between an open position with the upper seal apertures 24 and the lower seal apertures aligned and a closed position with the upper seal apertures 24 and the lower seal apertures nonaligned. In using the present invention, first a liquid is placed into the lower chamber 18, then the upper seal 20 and lower seal 22 are rotated to a closed position and a dry food is placed into the upper chamber 16. The bottle 10 is sealed by affixing the threaded nipple top 12. When the user is ready to mix the liquid with the dry food, the upper seal 20 and the lower seal 22 are rotated to an open position and the dry food is mixed with the liquid. In a preferred embodiment of the invention, the dry food is powdered baby formula and the liquid is water. A locking mechanism, such as a pull-pin safety latch 28, prevents undesired rotation of the upper seal 20 and the lower seal 22. Optionally, the upper seal 22 further comprises an o-ring 30. The dual chamber baby bottle 10 of the present invention can further include a screw-on bottom 42 and/or a graduated measurement scale 46.

Figure 4B:
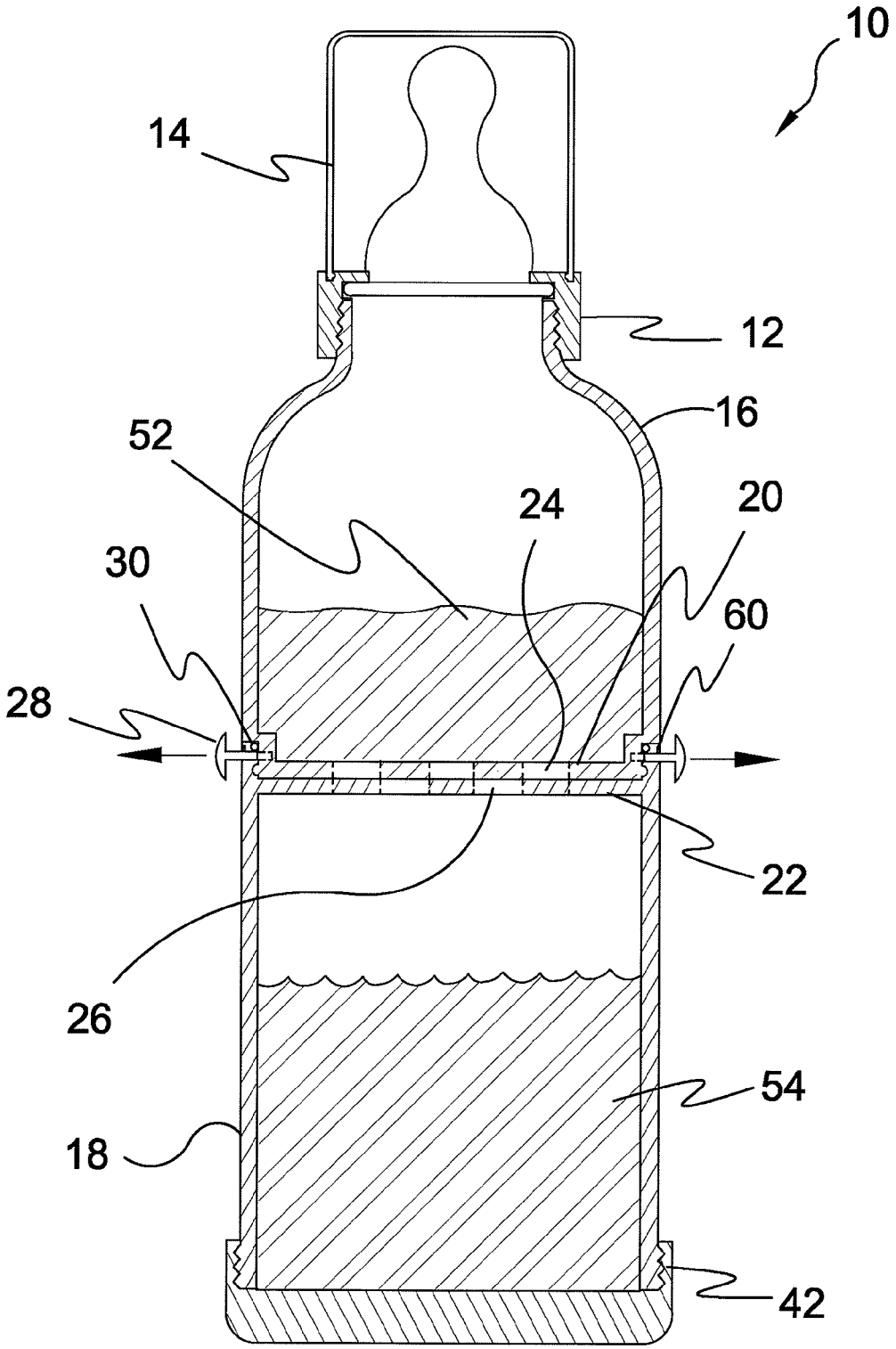
FIG. 4B is a sectional view of the third design of the present invention.

FIG. 4B is a sectional view of the third design of the present invention 10. Shown is a sectional view of the third design of the present invention, a dual chambered baby bottle 10 having a threaded nipple top 12, a plastic cover 14 for the threaded nipple top 12, an upper chamber 16 in fluid communication with the nipple top 12, a lower chamber 18, an upper seal 20 forming a lower portion of the upper chamber, a lower seal 22 adjacent the upper seal 20, the lower seal 22 forming an upper portion of the lower chamber, a plurality of upper seal apertures 24 in the upper seal 20, and a plurality of lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 nonaligned. In using the present invention, first a liquid 54 is placed into the lower chamber 18, then the upper seal 20 and lower seal 22 are rotated to a closed position and a dry powered formula 52 is placed into the upper chamber 16. The bottle 10 is sealed by affixing the threaded nipple top 12. When the user is ready to mix the liquid with the dry food, the upper seal 20 and the lower seal 22 are rotated to an open position and the dry food is mixed with the liquid. In a preferred embodiment of the invention, the dry food is powdered baby formula and the liquid is water. A locking mechanism, such as a pull-pin safety latch 28 and pin stop 60, prevents undesired rotation of the upper seal 20 and the lower seal 22. Shown is the pull pin safety latch 28 pulled out of the pin stop 60 to allow for the rotation of the chambers. Optionally, the upper seal 22 further comprises an o-ring 30. The dual chamber baby bottle 10 of the present invention can further include a screw-on bottom 42.

Figure 4C:
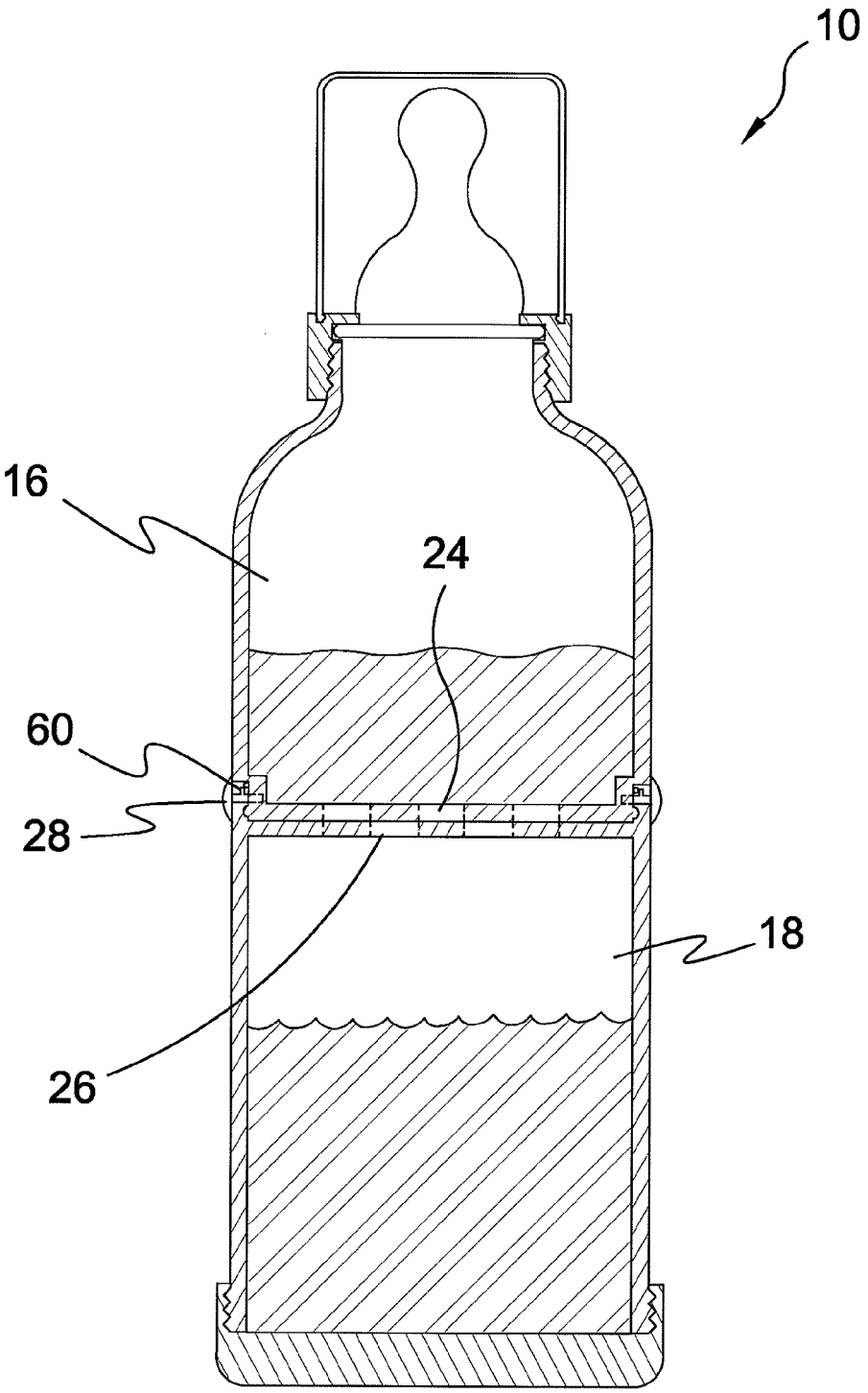
FIG. 4C is a sectional view of the third design of the present invention with pin locked.

FIG. 4C is a sectional view of the third design of the present invention 10 with pull pin latch 28 inserted into the pin stop 60 thereby locking the upper chamber 16 and the lower chamber 18 to prevent the casual rotation thereof and maintain the nonalignment of the upper seal apertures 24 and the lower seal apertures 26 in the closed position.

Figure 4D:
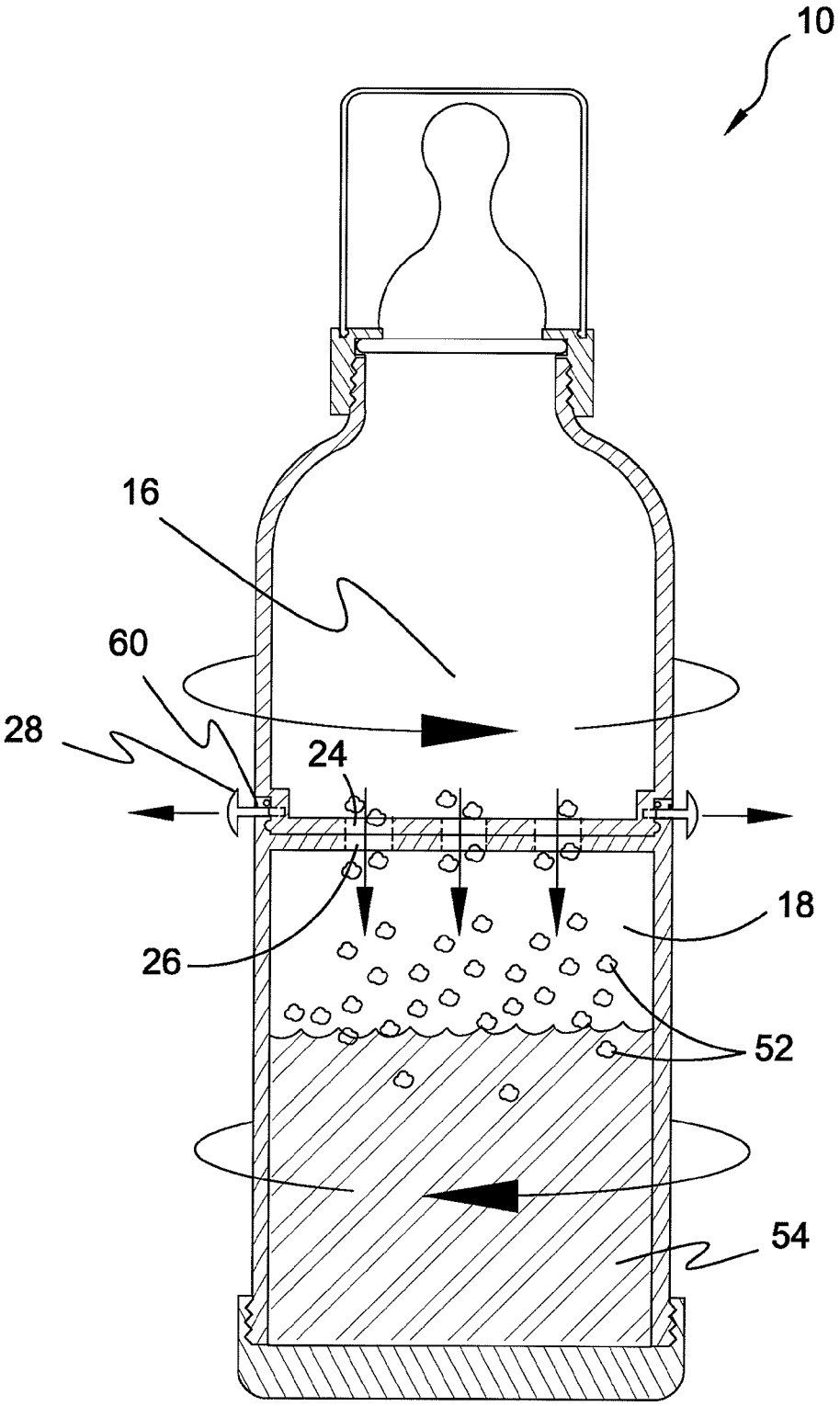
FIG. 4D is a sectional view of a third design of the present invention in an open position.

FIG. 4D is a sectional view of a third design of the present invention 10 with pull pin latch 28 withdrawn from the pin stop 60 thereby unlocking the upper chamber 16 and the lower chamber 18 to enable the user to rotate them to align the upper seal apertures 24 and the lower seal apertures 26 in the open position and release the dry formula 52 into the fluid 54.

Figure 4E:
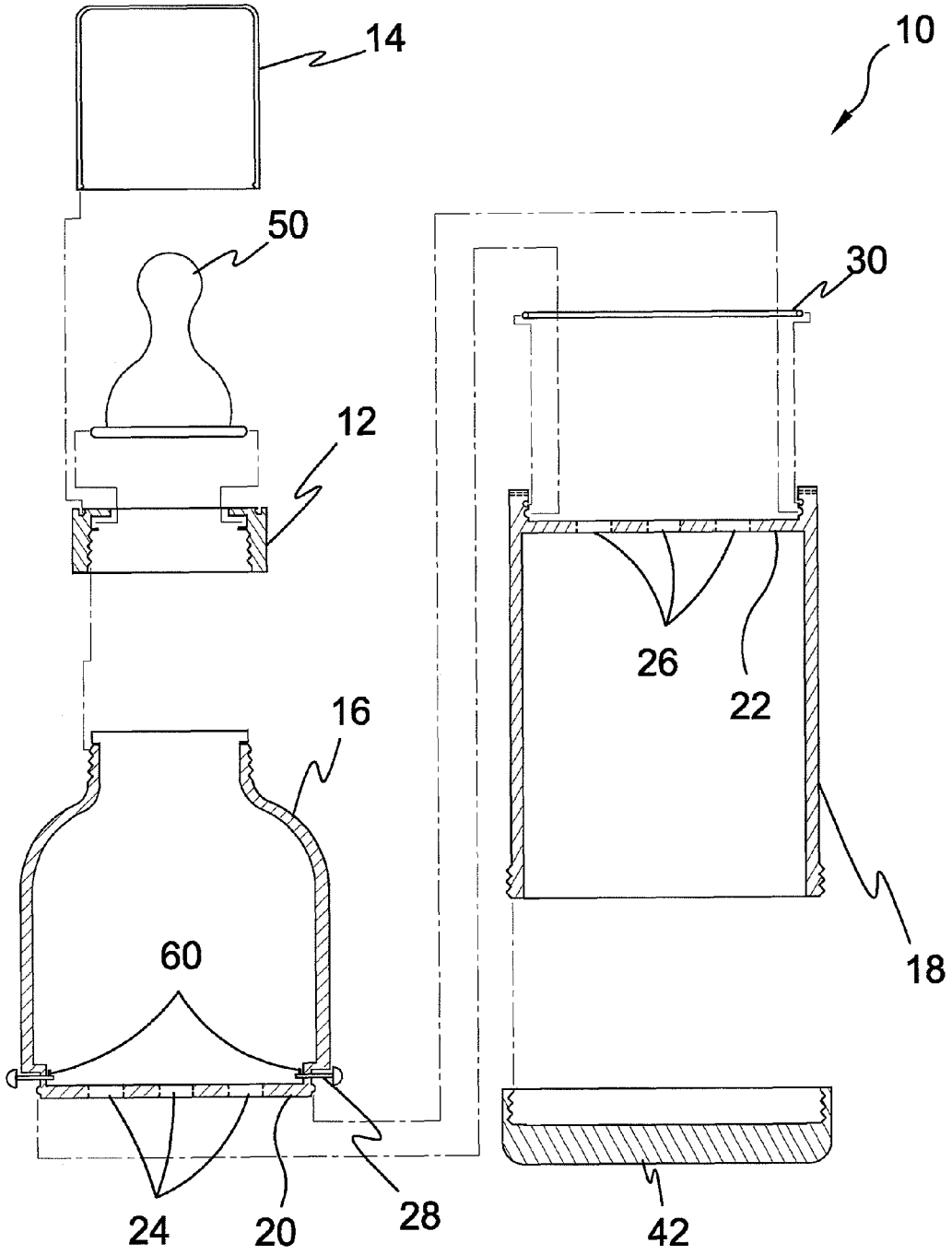
FIG. 4E is an exploded view of the third design of the present invention.

FIG. 4E is an exploded view of the third design of the present invention 10. Shown is an exploded view of the third design of the present invention, a dual chambered baby bottle 10 having a threaded nipple top 12, a plastic cover 14 for the threaded nipple top 12 with nipple 50, an upper chamber 16 in fluid communication with the nipple top 12, a lower chamber 18, an upper seal 20 forming a lower portion of the upper chamber, a lower seal 22 adjacent the upper seal 20, the lower seal 22 forming an upper portion of the lower chamber, a plurality of upper seal apertures 24 in the upper seal 20, and a plurality of lower seal apertures 26 in the lower seal 22, the upper seal 20 and lower seal 22 rotatable between an open position with the upper seal apertures 24 and the lower seal apertures 26 aligned and a closed position with the upper seal apertures 24 and the lower seal apertures 26 nonaligned. In using the present invention, first a liquid is placed into the lower chamber 18, then the upper seal 20 and lower seal 22 are rotated to a closed position and a dry food is placed into the upper chamber 16. The bottle 10 is sealed by affixing the threaded nipple top 12. When the user is ready to mix the liquid with the dry food, the upper seal 20 and the lower seal 22 are rotated to an open position and the dry food is mixed with the liquid. In a preferred embodiment of the invention, the dry food is powdered baby formula and the liquid is water. A locking mechanism, such as a pull-pin safety latch 28, prevents undesired rotation of the upper seal 20 and the lower seal 22. Optionally, the upper seal 22 further comprises an o-ring 30. The dual chamber baby bottle 10 of the present invention can further include a screw-on bottom 42.

Each embodiment disclosed above may include or be configured for use with any conventional bottle top, cap, or cover—such as a crown cork, threaded screw cap, any type of stopper (e.g., cork, glass), sports cap, pull-off top, and the like—in place of or in addition to the plastic cover 14, threaded nipple top 12, and nipple 50. For example, upper chamber 16 of FIG. 2A may be configured to accept a threaded screw cap—similar to screw-on bottom 48 of FIG. 2J—in place of the threaded nipple top 12. Additionally, all bottles described herein may be configured so that bottle tops, including the threaded nipple top, are interchangeable, e.g., depending on the desired use of the bottle.

Figure 5A:
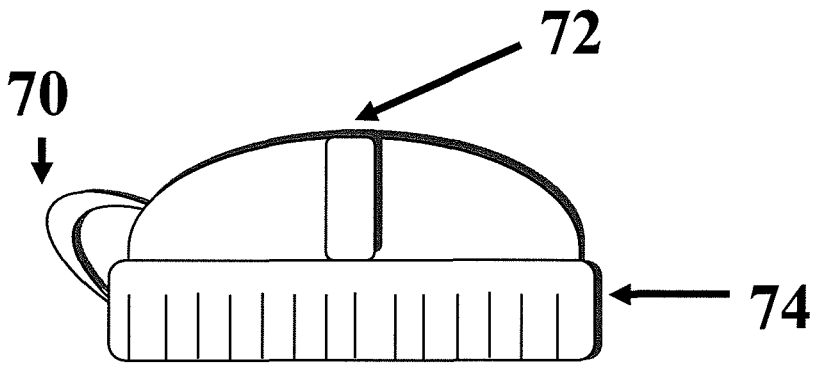
FIG. 5A illustrates, an example top included in or configured for use with the embodiments disclosed in FIGS. 1-4E.
Figure 5B:
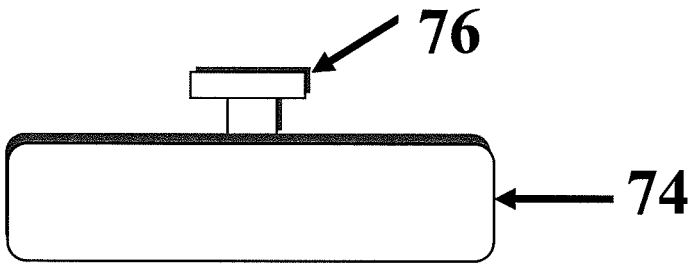
FIG. 5B illustrates an example top included in or configured for use with the embodiments disclosed in FIGS. 1-4E.

FIGS. 5A and 5B illustrate examples of tops that may be included or configured for use with the bottles described in this disclosure. The example top illustrated in FIG. 5A includes an optional connector 70, a built-in straw 72, and a removable lid 74. As depicted, the built-in straw 72 may be shielded or protected by a cover—such as plastic cover 14 of FIG. 2A—which detachably engages the removable lid 74. The cover, connector 70, built-in straw 72, and removable lid 74 may be glass, plastic, metal (e.g., stainless steel), or any other suitable material. A user of the top illustrated in FIG. 5A may disengage the cover from the removable lid 74 to access the built-in straw 72. In some embodiments, a hermetic seal may form when the cover is engaged with the removable lid 74, adding additional protection to the built-in straw 72 and the contents of the bottle.

Some embodiments include a connector, such as the optional connector 70, which couples the cover to the removable lid 74. The optional connector 70 may be included to prevent a user from losing the cover, as the cover is affixed to the removable lid 74, which may be affixed to the bottle.

The removable lid 74 detachably attaches to the bottle. In the embodiments described by FIGS. 1-4E, the removable lid 74 may be configured to detachably attach to the upper chamber 16 and/or the lower chamber 18. In some embodiments, the removable lid 74 includes a threaded connector that engages or attaches to a threaded connector disposed on an outer surface of the bottle. In these embodiments, the removable lid 74 may be screwed onto and off of the bottle. In other embodiments, the removable lid 74 may be a snap-fit type lid that attaches to and detaches from the bottle via the application of pressure. The mechanisms described herein for detachably mating the cover to the removable lid 74, and the removable lid 74 to the bottle are merely examples. All other mechanisms known to a skilled artisan are within the scope of this disclosure.

The example top illustrated in FIG. 5B includes a retractable tab 76 and a removable lid 74. While not depicted, the top illustrated in FIG. 5B may include a cover and an optional connector 70 as described with respect to FIG. 5A. The components of FIG. 5B may be glass, plastic, metal (e.g., stainless steel), or any other suitable material.

The retractable tab 76 of FIG. 5B may extend to a first position by the application of pressure in a direction away from and generally perpendicular to the surface of the removable lid 74. Likewise, the retractable tab 76 may retract to a second position by the application of pressure in a direction toward and generally perpendicular to the surface of the removable lid 74. The distance between the retractable tab 76 and the removable lid 74 is greater in the first position than in the second position. Additionally, the contents of the bottle are generally accessible when the retractable tab 76 is in the first position (e.g., may be poured out); whereas the contents of the bottle are generally inaccessible when the retractable tab 76 is in the second position. The retractable tab 76 may include a hole or other mechanism through which the contents of the bottle may be expelled.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

As should be readily apparent to one having ordinary skill in the art, the features disclosed in the embodiments described above may be incorporated in any bottle or, more generally, container having plural chambers. Additionally, the bottle or container may be configured for any use, and each chamber may be configured to store or hold any substance. As such, the bottle or container disclosed herein may be configured for any use or task requiring the storage of substances in separate chambers, and subsequent mixing or combining of the substances.

One or more embodiments described above may be configured to store and/or mix/combine substances associated with nutrition, nutritional supplements, medicine, chemicals, household or industrial cleaning agents, consumer products, toiletries, cosmetics (e.g., makeup), and the like. Additionally, one or more containers disclosed herein may be reusable, one-time use, and/or recyclable.

One or more embodiments described above may be configured for use by a human (such as a human baby, an athlete, the disabled, the elderly, and the like) or an animal, i.e., non-human, (such as a farm animal, a domestic pet, and the like). In one example, a container within the scope of this disclosure is configured to store and/or administer nutrition to a human baby, e.g., neonate, newborn, infant, child, etc. In another example, a container within the scope of this disclosure is configured to store and/or administer nutrition or nutritional supplements to an athlete, a disabled individual, or an elderly individual. In this example, a conventional bottle top, cap, or cover (e.g., crown cork, threaded screw cap, any type of stopper (e.g., cork, glass), sports cap, pull-off top, and the like) may be used in place of a threaded nipple top with nipple. In yet another example, farmers, animal breeders, clinical researchers, veterinarians, pet owners, and the like can store and/or administer nutrition, nutritional supplements, medicine and the like to an animal, including a non-human baby, using a container described herein. These examples are not meant to be limiting, as one having ordinary skill in the art may configure the containers disclosed herein to store any substance for any desired use.

What is claimed is new and desired to be protected by Letters Patent is set forth in the appended claims:

1. A container comprising:

a first compartment comprising a first seal having at least one first aperture;

a second compartment comprising a second seal having at least one second aperture, wherein the first compartment and the second compartment are detachably coupled such that an interface of the first and second compartments at an outer surface of the container has a generally smooth and continuous surface; and a rotation mechanism disposed within the outer surface of the container and adjacent to the interface of the first and second compartments and facilitating rotation of the first seal relative to the second seal between a first position where the first and second apertures are nonaligned and a second position where the first and second apertures are aligned;

wherein the rotation mechanism comprises a spring unit configured to fix the first seal relative to the second seal in one of the first position and the second position until rotational force is applied to one of the first compartment and the second compartment.

2. The container of claim 1, further comprising a first cap configured to detachably couple to the first compartment and cover a first opening in the first compartment, the first opening disposed opposite the first seal.

3. The container of claim 2, wherein the first cap is one of a crown cork, a threaded screw top, a stopper, a sports top, and a snap-fit top.

4. The container of claim 2, wherein the first cap comprises a straw and a protective cover configured to cover the straw.

5. The container of claim 2, wherein the first cap comprises a retractable tab.

6. The container of claim 2, wherein the first cap comprises a nipple.

7. The container of claim 1, further comprising a second cap configured to detachably couple to the second compartment and to cover a second opening in the second compartment, the second opening disposed opposite the second seal.

8. The container of claim 1, wherein the spring unit comprises:

a first spring lock port disposed in the second compartment and adjacent to the second seal; and a spring pin configured to engage the first spring lock port when the first seal is in the first position, wherein applying rotational force to one of the first compartment and the second compartment disengages the spring pin from the spring lock port such that the first seal rotates to the second position.

9. The container of claim 8, wherein the spring unit further comprises a second spring lock port disposed in the second compartment and adjacent to the second seat, wherein the spring pin is configured to engage the second spring lock port to fix the first seal in the second position where the first and second apertures are aligned.

10. The container of claim 1, wherein the rotation mechanism comprises:

a channel disposed in the second compartment; and a pin configured to travel in the channel when rotational force is applied to one of the first compartment and the second compartment to rotate the first seal between the first and second positions.

11. The container of claim 1, further comprising an o-ring disposed adjacent to the rotation mechanism and the interface of the first and second compartments, and within the outer surface of the container.

* * * * *